US011408673B2

(12) United States Patent
Ducote, Jr. et al.

(10) Patent No.: US 11,408,673 B2
(45) Date of Patent: Aug. 9, 2022

(54) MIXED REFRIGERANT SYSTEM AND METHOD

(71) Applicant: Chart Energy & Chemicals, Inc., Ball Ground, GA (US)

(72) Inventors: Douglas A. Ducote, Jr., The Woodlands, TX (US); Timothy P. Gushanas, Pearland, TX (US); Peter J. Turner, The Woodlands, TX (US); Brent Heyrman, The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 0 days.

(21) Appl. No.: 16/856,555

(22) Filed: Apr. 23, 2020

(65) Prior Publication Data

US 2020/0318872 A1 Oct. 8, 2020

Related U.S. Application Data

(63) Continuation-in-part of application No. 16/545,695, filed on Aug. 20, 2019, which is a continuation-in-part of application No. 14/218,949, filed on Mar. 18, 2014, now Pat. No. 10,480,851.

(60) Provisional application No. 61/802,350, filed on Mar. 15, 2013.

(51) Int. Cl.

| | |
|---|---|
| ***F25J 1/00*** | (2006.01) |
| ***F25J 3/06*** | (2006.01) |
| ***F25J 1/02*** | (2006.01) |

(52) U.S. Cl.

CPC ..... *F25J 1/0055* (2013.01); *F25J 1/0022* (2013.01); *F25J 1/0212* (2013.01); *F25J 1/0262* (2013.01); *F25J 1/0291* (2013.01); *F25J 3/0615* (2013.01); *F25J 2210/62* (2013.01); *F25J 2220/64* (2013.01); *F25J 2290/32* (2013.01)

(58) Field of Classification Search

CPC ..... F25J 1/005; F25J 1/0212; F25J 1/0262; F25J 2220/64; F25J 2290/32

See application file for complete search history.

(56) References Cited

U.S. PATENT DOCUMENTS

| | | | |
|---|---|---|---|
| 2,041,725 | A | 5/1936 | Podbielniak |
| 3,364,685 | A | 1/1968 | Perret |
| 3,645,106 | A | 2/1972 | Gaumer, Jr. et al. |
| 3,729,945 | A | 5/1973 | Linnett |
| 4,033,735 | A | 7/1977 | Swenson |
| 4,057,972 | A | 11/1977 | Sarsten |
| 4,112,700 | A | 9/1978 | Forg |

(Continued)

FOREIGN PATENT DOCUMENTS

| | | | |
|---|---|---|---|
| CN | 202361751 | U | 8/2012 |
| CN | 102748919 | A | 10/2012 |

(Continued)

OTHER PUBLICATIONS

International Search Report and Written Opinion issued for International Application No. PCT/US2011/027162, dated May 3, 2011 (10 Pages).

(Continued)

*Primary Examiner* — Jenna M Hopkins
(74) *Attorney, Agent, or Firm* — Cook Alex Ltd.

(57) ABSTRACT

Provided are mixed refrigerant systems and methods and, more particularly, to a mixed refrigerant system and methods that provides greater efficiency and reduced power consumption.

20 Claims, 24 Drawing Sheets

(56) References Cited

U.S. PATENT DOCUMENTS

| | | | |
|---|---|---|---|
| RE30,085 | E | 8/1979 | Perret |
| 4,251,247 | A | 2/1981 | Gauberthier et al. |
| 4,274,849 | A | 6/1981 | Garier et al. |
| 4,504,296 | A | 3/1985 | Newton et al. |
| 4,525,185 | A | 6/1985 | Newton |
| 4,545,795 | A | 10/1985 | Liu et al. |
| 4,586,942 | A | 5/1986 | Gauthier |
| 4,689,063 | A | 8/1987 | Paradowski et al. |
| 4,856,942 | A | 8/1989 | Bernadic et al. |
| 4,901,533 | A | 2/1990 | Fan et al. |
| 5,535,594 | A | 7/1996 | Grenier |
| 5,644,931 | A | 7/1997 | Ueno et al. |
| 5,657,643 | A | 8/1997 | Price |
| 5,718,126 | A | 2/1998 | Capron et al. |
| 5,746,066 | A | 5/1998 | Manley |
| 5,768,912 | A | 6/1998 | Dubar |
| 5,813,250 | A | 9/1998 | Ueno et al. |
| 5,950,450 | A | 9/1999 | Meyer et al. |
| 6,041,619 | A | 3/2000 | Fischer et al. |
| 6,065,305 | A | 5/2000 | Arman et al. |
| 6,250,105 | B1 | 6/2001 | Kimble |
| 6,253,574 | B1 | 7/2001 | Stockmann et al. |
| 6,269,655 | B1 | 8/2001 | Roberts et al. |
| 6,289,692 | B1 | 9/2001 | Houser et al. |
| 6,295,833 | B1 | 10/2001 | Hoffart et al. |
| 6,298,688 | B1 | 10/2001 | Brostow et al. |
| 6,308,531 | B1 | 10/2001 | Robert et al. |
| 6,324,867 | B1 | 12/2001 | Fanning et al. |
| 6,334,334 | B1 | 1/2002 | Stockmann et al. |
| 6,347,531 | B1 | 2/2002 | Roberts et al. |
| 6,347,532 | B1 | 2/2002 | Agrawal et al. |
| 6,367,286 | B1 | 4/2002 | Price |
| 6,378,330 | B1 | 4/2002 | Minta et al. |
| 6,389,844 | B1 | 5/2002 | Klein Nagel Voort |
| 6,449,984 | B1 | 9/2002 | Paradowski |
| 6,530,240 | B1 | 3/2003 | Kountz et al. |
| 6,622,518 | B2 | 9/2003 | Park |
| 6,694,774 | B1 | 2/2004 | Rashad et al. |
| 6,725,688 | B2 | 4/2004 | Elion et al. |
| 6,742,357 | B1 | 6/2004 | Roberts |
| 7,082,787 | B2 | 8/2006 | Lee et al. |
| 7,086,251 | B2 | 8/2006 | Roberts |
| 7,127,914 | B2 | 10/2006 | Roberts et al. |
| 7,308,805 | B2 | 12/2007 | Roberts |
| 7,310,971 | B2 | 12/2007 | Eaton et al. |
| 7,415,840 | B2 | 8/2008 | Eaton et al. |
| 7,565,815 | B2 | 7/2009 | Wilkinson et al. |
| 7,591,149 | B2 | 9/2009 | Ransbarger et al. |
| 7,628,035 | B2 | 12/2009 | Paradowski |
| 7,673,476 | B2 | 3/2010 | Whitesell |
| 8,020,406 | B2 | 9/2011 | Vandor et al. |
| 8,117,852 | B2 | 2/2012 | Mak |
| 8,181,481 | B2 | 5/2012 | Jager |
| 8,273,152 | B2 | 9/2012 | Schwartz et al. |
| 8,312,734 | B2 | 11/2012 | Lewis |
| 8,418,481 | B2 | 4/2013 | Minor et al. |
| 8,424,340 | B2 | 4/2013 | Eaton et al. |
| 8,434,325 | B2 | 5/2013 | Martinez et al. |
| 8,438,874 | B2 | 5/2013 | Koganezawa et al. |
| 8,464,551 | B2 | 6/2013 | Roberts et al. |
| 2004/0231359 | A1 | 11/2004 | Brostow et al. |
| 2005/0198998 | A1 | 9/2005 | Lee et al. |
| 2007/0227185 | A1 | 10/2007 | Stone et al. |
| 2007/0283718 | A1 | 12/2007 | Hulsey et al. |
| 2008/0016910 | A1 | 1/2008 | Brostow et al. |
| 2008/0141711 | A1 | 6/2008 | Roberts et al. |
| 2009/0071190 | A1 | 3/2009 | Potthoff et al. |
| 2009/0205366 | A1 | 8/2009 | Schmidt |
| 2009/0217701 | A1 | 9/2009 | Minta et al. |
| 2009/0241593 | A1 | 10/2009 | Jager et al. |
| 2010/0031699 | A1 | 2/2010 | Dam et al. |
| 2010/0147024 | A1 | 6/2010 | Roberts et al. |
| 2010/0154469 | A1 | 6/2010 | Eaton et al. |
| 2010/0186445 | A1 | 7/2010 | Minta et al. |
| 2010/0186929 | A1 | 7/2010 | Chantant et al. |
| 2010/0281915 | A1 | 11/2010 | Roberts et al. |
| 2011/0185767 | A1 | 8/2011 | Jager et al. |
| 2011/0219819 | A1 | 9/2011 | Bauer et al. |
| 2011/0226008 | A1 | 9/2011 | Gushanas et al. |
| 2012/0047943 | A1 | 3/2012 | Barclay et al. |
| 2012/0067080 | A1 | 3/2012 | Byfield et al. |
| 2012/0137726 | A1 | 6/2012 | Currence et al. |
| 2013/0008204 | A1 | 1/2013 | Kim et al. |
| 2013/0061632 | A1 | 3/2013 | Brostow et al. |
| 2013/0072740 | A1 | 3/2013 | Hillman |
| 2013/0133362 | A1 | 5/2013 | Lee et al. |
| 2013/0139544 | A1 | 6/2013 | Mak |
| 2013/0213087 | A1 | 8/2013 | Currence |

FOREIGN PATENT DOCUMENTS

| | | | |
|---|---|---|---|
| DE | 19612173 | C1 | 5/1997 |
| DE | 19937623 | A1 | 2/2001 |
| DE | 10209799 | A1 | 9/2003 |
| DE | 102005053267 | A1 | 5/2007 |
| DE | 10194530 | B4 | 10/2007 |
| DE | 102010011052 | A1 | 9/2011 |
| DE | 102011104725 | A1 | 12/2012 |
| EP | 0008823 | A1 | 3/1980 |
| EP | 0768502 | A1 | 4/1997 |
| EP | 0644996 | B1 | 12/1998 |
| EP | 0975923 | A1 | 2/2000 |
| EP | 1016842 | A1 | 7/2000 |
| EP | 1092930 | A1 | 4/2001 |
| EP | 1092931 | A1 | 4/2001 |
| EP | 1118827 | A1 | 5/2001 |
| EP | 1144928 | A2 | 10/2001 |
| EP | 0990108 | B1 | 9/2002 |
| EP | 1248935 | A1 | 10/2002 |
| EP | 1137902 | A2 | 1/2003 |
| EP | 1273860 | A2 | 1/2003 |
| EP | 1306632 | A1 | 5/2003 |
| EP | 1309973 | A2 | 5/2003 |
| EP | 1352203 | A1 | 10/2003 |
| EP | 1397629 | A1 | 3/2004 |
| EP | 1092932 | B1 | 12/2004 |
| EP | 1092933 | B1 | 12/2004 |
| EP | 1304535 | B1 | 2/2005 |
| EP | 1455152 | B1 | 7/2005 |
| EP | 1323994 | B1 | 10/2005 |
| EP | 1281033 | B1 | 2/2006 |
| EP | 1790926 | A1 | 5/2007 |
| EP | 1881283 | A2 | 1/2008 |
| EP | 2110630 | A2 | 10/2009 |
| EP | 1456589 | B1 | 1/2010 |
| EP | 2199716 | A2 | 6/2010 |
| EP | 1668300 | B1 | 8/2010 |
| EP | 2251625 | A2 | 11/2010 |
| EP | 2562501 | A2 | 2/2013 |
| EP | 1613909 | B1 | 3/2013 |
| EP | 2600088 | A2 | 6/2013 |
| FR | 2764972 | A1 | 12/1998 |
| FR | 2841330 | A1 | 12/2003 |
| FR | 2885679 | A1 | 11/2006 |
| FR | 2891900 | A1 | 4/2007 |
| GB | 248711 | | 3/1927 |
| GB | 1122830 | A | 8/1968 |
| GB | 2326464 | A | 12/1998 |
| GB | 2326465 | A | 12/1998 |
| JP | H8-159652 | A | 6/1996 |
| JP | H9-113129 | A | 5/1997 |
| JP | 2011506894 | A | 3/2001 |
| JP | 2002508055 | A | 3/2002 |
| JP | 2002532674 | A | 10/2002 |
| WO | 9424500 | A1 | 10/1994 |
| WO | 9848227 | A1 | 10/1998 |
| WO | 9859206 | A1 | 12/1998 |
| WO | 0036350 | A2 | 6/2000 |
| WO | 0139200 | A2 | 5/2001 |
| WO | 01044735 | A1 | 6/2001 |
| WO | 0229337 | A1 | 4/2002 |
| WO | 02050483 | A1 | 6/2002 |
| WO | 02101307 | A1 | 12/2002 |
| WO | 03074955 | A1 | 9/2003 |

(56) References Cited

FOREIGN PATENT DOCUMENTS

| | | | |
|---|---|---|---|
| WO | 2004083753 | A2 | 9/2004 |
| WO | 2005028976 | A1 | 3/2005 |
| WO | 2006007278 | A2 | 1/2006 |
| WO | 2006009610 | A2 | 1/2006 |
| WO | 2006047098 | A2 | 5/2006 |
| WO | 2006094675 | A1 | 9/2006 |
| WO | 2006120127 | A2 | 11/2006 |
| WO | 2007021351 | A1 | 2/2007 |
| WO | 2007042662 | A2 | 4/2007 |
| WO | 2007120782 | A2 | 10/2007 |
| WO | 2008006867 | A2 | 1/2008 |
| WO | 2008009721 | A2 | 1/2008 |
| WO | 2008020044 | A2 | 2/2008 |
| WO | 2008034875 | A2 | 3/2008 |
| WO | 2008074718 | A2 | 6/2008 |
| WO | 2009007435 | A2 | 1/2009 |
| WO | 2009029140 | A1 | 3/2009 |
| WO | 2009050178 | A2 | 4/2009 |
| WO | 2009061777 | A1 | 5/2009 |
| WO | 2009072900 | A1 | 6/2009 |
| WO | 2009085937 | A1 | 7/2009 |
| WO | 2010058277 | A2 | 5/2010 |
| WO | 2010096223 | A1 | 8/2010 |
| WO | 2010096305 | A1 | 8/2010 |
| WO | 2010133482 | A2 | 11/2010 |
| WO | 2011115760 | A1 | 9/2011 |
| WO | 2011117655 | A2 | 9/2011 |
| WO | 2012023752 | A2 | 2/2012 |
| WO | 2012075266 | A2 | 6/2012 |
| WO | 2012112692 | A1 | 8/2012 |
| WO | 2012167007 | A1 | 12/2012 |
| WO | 2013055305 | A1 | 4/2013 |
| WO | 2013081979 | A1 | 6/2013 |
| WO | 2013087570 | A2 | 6/2013 |
| WO | 2013087571 | A2 | 6/2013 |
| WO | 2014116363 | A1 | 7/2014 |

OTHER PUBLICATIONS

International Preliminary Report on Patentability for International Application No. PCT/US2011/027162, dated Sep. 18, 2012 (8 pages).

International Search Report and Written Opinion from the International Bureau for International Application No. PCT/US2014/031135, dated Aug. 19, 2014 (9 pages).

International Preliminary Report on Patentability from the International Bureau for International Application No. PCT/US2014/031135, dated Mar. 9, 2015 (25 pages).

Office Action issued in Mexican Application No. MX/a/2012/010726, dated Mar. 12, 2015 with English translation (9 pages).

Supplementary European Search Report issued in EP11756720, dated Jun. 1, 2015 (8 pages).

International Search Report and Written Opinion of the International Searching Authority, PCT/US2016/026924, dated Aug. 19, 2016 (11 pages).

Extended European Search Report from the European Patent Office for European Application No. EP 14762447.2, dated Jun. 19, 2017 (14 pages).

Notification of Reasons for Rejection from the Third Examination Department of the Japanese Patent Office for Japanese Patent Application No. 2016-502613, dated Jun. 20, 2018 with English translation (15 pages).

| Stream Name | | FEED | PRODUCT | 14 | 18 | 22 | 24 |
|---|---|---|---|---|---|---|---|
| Stream Description | | Feed Gas | LNG | 1st Stage Inlet | 1st Stage Discharge | Interstage Drum Inlet | 2nd Stage Inlet |
| | | | | | | | |
| Phase | | Vapor | Liquid | Vapor | Vapor | Mixed | Vapor |
| | | | | | | | |
| Temperature | C | 34.59 | -163.00 | 9.38 | 80.42 | 35.00 | 34.77 |
| Pressure | BAR | 54.01 | 53.61 | 4.40 | 16.99 | 16.51 | 16.51 |
| | | | | | | | |
| Flowrate | KG-MOL/HR | 1,003.3 | 1,003.3 | 3,429.2 | 3,429.2 | 3,429.2 | 2,913.2 |
| Total Mass Rate | KG/HR | 16,356.5 | 16,356.5 | 124,209.4 | 124,209.4 | 124,209.4 | 96,868.1 |
| Total Molecular Weight | | 16.30 | 16.30 | 36.22 | 36.22 | 36.22 | 33.25 |
| | | | | | | | |
| Composition | Mole% | | | | | | |
| N2 | | 1.00 | 1.00 | 6.31 | 6.31 | 6.31 | 7.38 |
| METHANE | | 98.00 | 98.00 | 19.32 | 19.32 | 19.32 | 22.41 |
| C2H4 | | 0.00 | 0.00 | 33.83 | 33.83 | 33.83 | 38.49 |
| ETHANE | | 1.00 | 1.00 | 0.00 | 0.00 | 0.00 | 0.00 |
| C3 | | 0.00 | 0.00 | 12.14 | 12.14 | 12.14 | 11.74 |
| BUTANE | | 0.00 | 0.00 | 28.41 | 28.41 | 28.41 | 19.98 |
| **High/Low Ranges** | | | | | | | |
| High Temperature | C | 50.00 | -140.00 | 50.00 | | 50.00 | |
| Low Temperature | C | -40.00 | -165.00 | -60.00 | | -40.00 | |
| High Pressure | BAR | 72.00 | 72.00 | 12.00 | | 25.00 | |
| Low Pressure | BAR | 20.00 | 20.00 | 2.00 | | 8.00 | |

FIG. 14A

| Stream Name | | 28 | 32 | 34 | 36 | 38 |
|---|---|---|---|---|---|---|
| Stream Description | | 2nd Stage Discharge | Accumulator Inlet | Accumulator Vapor | Accumulator Liquid | Mid Boiling Refrigerant Inlet |
| | | | | | | |
| Phase | | Vapor | Mixed | Vapor | Liquid | Liquid |
| | | | | | | |
| Temperature | C | 68.16 | 35.00 | 35.00 | 35.00 | 35.00 |
| Pressure | BAR | 27.88 | 27.40 | 27.40 | 27.40 | 27.40 |
| | | | | | | |
| Flowrate | KG-MOL/HR | 2,913.2 | 2,913.2 | 2,474.4 | 438.8 | 351.0 |
| Total Mass Rate | KG/HR | 96,868.1 | 96,868.1 | 75,527.5 | 21,340.6 | 17,072.5 |
| Total Molecular Weight | | 33.25 | 33.25 | 30.52 | 48.64 | 48.64 |
| | | | | | | |
| Composition | Mole% | | | | | |
| N2 | | 7.38 | 7.38 | 8.58 | 0.60 | 0.60 |
| METHANE | | 22.41 | 22.41 | 25.60 | 4.42 | 4.42 |
| C2H4 | | 38.49 | 38.49 | 42.49 | 15.94 | 15.94 |
| ETHANE | | 0.00 | 0.00 | 0.00 | 0.00 | 0.00 |
| C3 | | 11.74 | 11.74 | 10.47 | 18.92 | 18.92 |
| BUTANE | | 19.98 | 19.98 | 12.86 | 60.12 | 60.12 |
| **High/Low Ranges** | | | | | | |
| High Temperature | C | 130.00 | 50.00 | | | |
| Low Temperature | C | 40.00 | -40.00 | | | |
| High Pressure | BAR | 72.00 | 72.00 | | | |
| Low Pressure | BAR | 22.00 | 22.00 | | | |

FIG. 14B

| Stream Name | | 40 | 48 | 104A | 108A | 112 |
|---|---|---|---|---|---|---|
| Stream Description | | Spillback | High Boiling Refrigerant Inlet | Low Pressure MR Vapor Outlet | Low Pressure High Boiling Re-frigerant Outlet | Subcooled Cold Separator Vapor |
| | | | | | | |
| Phase | | Liquid | Liquid | Vapor | Mixed | Liquid |
| | | | | | | |
| Temperature | C | 35.00 | 34.77 | 31.88 | 31.88 | -163.00 |
| Pressure | BAR | 27.40 | 16.51 | 4.50 | 4.50 | 27.20 |
| | | | | | | |
| Flowrate | KG-MOL/HR | 87.8 | 603.8 | 2,825.4 | 603.8 | 998.7 |
| Total Mass Rate | KG/HR | 4,268.1 | 31,609.4 | 92,600.0 | 31,609.4 | 23,176.3 |
| Total Molecular Weight | | 48.64 | 52.35 | 32.77 | 52.35 | 23.21 |
| | | | | | | |
| Composition | Mole% | | | | | |
| N2 | | 0.60 | 0.28 | 7.59 | 0.28 | 18.95 |
| METHANE | | 4.42 | 2.26 | 22.96 | 2.26 | 43.53 |
| C2H4 | | 15.94 | 8.72 | 39.19 | 8.72 | 35.60 |
| ETHANE | | 0.00 | 0.00 | 0.00 | 0.00 | 0.00 |
| C3 | | 18.92 | 15.05 | 11.52 | 15.05 | 1.35 |
| BUTANE | | 60.12 | 73.68 | 18.73 | 73.68 | 0.57 |
| **High/Low Ranges** | | | | | | |
| High Temperature | C | | | | | -140.00 |
| Low Temperature | C | | | | | -170.00 |
| High Pressure | BAR | | | | | 72.00 |
| Low Pressure | BAR | | | | | 22.00 |

FIG. 14C

| Stream Name | | 122 | 124 | 128 | 132 | 140 |
|---|---|---|---|---|---|---|
| Stream Description | | Low Pressure MR Vapor Inlet | Subcooled Mid Boiling Refrigerant | Subcooled Cold Separator Vapor | Low Pressure High Boiling Re-frigerant Outlet | Subcooled Mid Boiling Refrigerant |
| | | | | | | |
| Phase | | Mixed | Liquid | Liquid | Liquid | Liquid |
| | | | | | | |
| Temperature | C | -166.52 | -95.00 | -91.58 | -93.97 | -65.00 |
| Pressure | BAR | 4.80 | 27.20 | 27.20 | 4.70 | 16.31 |
| | | | | | | |
| Flowrate | KG-MOL/HR | 998.7 | 351.0 | 1,475.7 | 351.0 | 603.8 |
| Total Mass Rate | KG/HR | 23,176.3 | 17,072.5 | 52,351.2 | 17,072.5 | 31,609.4 |
| Total Molecular Weight | | 23.21 | 48.64 | 35.47 | 48.64 | 52.35 |
| | | | | | | |
| Composition | Mole% | | | | | |
| N2 | | 18.95 | 0.60 | 1.57 | 0.60 | 0.28 |
| METHANE | | 43.53 | 4.42 | 13.46 | 4.42 | 2.26 |
| C2H4 | | 35.60 | 15.94 | 47.15 | 15.94 | 8.72 |
| ETHANE | | 0.00 | 0.00 | 0.00 | 0.00 | 0.00 |
| C3 | | 1.35 | 18.92 | 16.64 | 18.92 | 15.05 |
| BUTANE | | 0.57 | 60.12 | 21.18 | 60.12 | 73.68 |
| **High/Low Ranges** | | | | | | |
| High Temperature | C | -145.00 | -50.00 | -50.00 | -55.00 | -20.00 |
| Low Temperature | C | -175.00 | -135.00 | -135.00 | -140.00 | -90.00 |
| High Pressure | BAR | 12.00 | 72.00 | 72.00 | 12.00 | 25.00 |
| Low Pressure | BAR | 2.00 | 22.00 | 22.00 | 2.00 | 8.00 |

FIG. 14D

| Stream Name | | 158 | 156 | 160 | 164 |
|---|---|---|---|---|---|
| Stream Description | | Low Pressure High Boiling Refrigerant Inlet | Cold Separator Liquid | Cold Separator Vapor | Cold Separator Feed |
| | | | | | |
| Phase | | Liquid | Liquid | Vapor | Mixed |
| | | | | | |
| Temperature | C | -64.49 | -39.00 | -39.00 | -39.00 |
| Pressure | BAR | 4.70 | 27.20 | 27.20 | 27.20 |
| | | | | | |
| Flowrate | KG-MOL/HR | 603.8 | 1,475.7 | 998.7 | 2,474.4 |
| Total Mass Rate | KG/HR | 31,609.4 | 52,351.2 | 23,176.3 | 75,527.5 |
| Total Molecular Weight | | 52.35 | 35.47 | 23.21 | 30.52 |
| | | | | | |
| Composition | Mole% | | | | |
| N2 | | 0.28 | 1.57 | 18.95 | 8.58 |
| METHANE | | 2.26 | 13.46 | 43.53 | 25.60 |
| C2H4 | | 8.72 | 47.15 | 35.60 | 42.49 |
| ETHANE | | 0.00 | 0.00 | 0.00 | 0.00 |
| C3 | | 15.05 | 16.64 | 1.35 | 10.47 |
| BUTANE | | 73.68 | 21.18 | 1.57 | 12.86 |
| **High/Low Ranges** | | | | | |
| High Temperature | C | -25.00 | | | -20.00 |
| Low Temperature | C | -95.00 | | | -80.00 |
| High Pressure | BAR | 12.00 | | | 72.00 |
| Low Pressure | BAR | 2.00 | | | 22.00 |

FIG. 14E

| Stream Name | | FEED | PRODUCT | 14 | 14L | 18 | 18L |
|---|---|---|---|---|---|---|---|
| Stream Description | | Feed Gas | LNG | 1st Stage Inlet | MP Pump Inlet | 1st Stage Discharge | MP Pump Discharge |
| | | | | | | | |
| Phase | | Vapor | Liquid | Vapor | Liquid | Vapor | Liquid |
| | | | | | | | |
| Temperature | C | 34.59 | -163.00 | 8.00 | 7.12 | 78.07 | 8.10 |
| Pressure | BAR | 54.01 | 53.61 | 4.40 | 4.40 | 16.99 | 16.99 |
| | | | | | | | |
| Flowrate | KG-MOL/HR | 1,003.3 | 1,003.3 | 3,503.5 | 59.4 | 3,503.5 | 59.4 |
| Total Mass Rate | KG/HR | 16,356.5 | 16,356.5 | 128,829.6 | 3,313.3 | 128,829.6 | 3,313.3 |
| Total Molecular Weight | | 16.30 | 16.30 | 36.77 | 55.79 | 36.77 | 55.79 |
| | | | | | | | |
| Composition | Mole% | | | | | | |
| N2 | | 1.00 | 1.00 | 6.17 | 0.00 | 6.17 | 0.00 |
| METHANE | | 98.00 | 98.00 | 18.83 | 0.01 | 18.83 | 0.01 |
| C2H4 | | 0.00 | 0.00 | 32.96 | 0.03 | 32.96 | 0.03 |
| ETHANE | | 1.00 | 1.00 | 0.00 | 0.00 | 0.00 | 0.00 |
| C3 | | 0.00 | 0.00 | 11.83 | 0.09 | 11.83 | 0.09 |
| BUTANE | | 0.00 | 0.00 | 30.21 | 0.88 | 30.21 | 0.88 |
| **High/Low Ranges** | | | | | | | |
| High Temperature | C | 50.00 | -140.00 | 50.00 | 50.00 | | |
| Low Temperature | C | -40.00 | -165.00 | -60.00 | -60.00 | | |
| High Pressure | BAR | 72.00 | 72.00 | 12.00 | 12.00 | | |
| Low Pressure | BAR | 20.00 | 20.00 | 2.00 | 2.00 | | |

FIG. 15A

| Stream Name | | 22 | 24 | 28 | 32 | 34 |
|---|---|---|---|---|---|---|
| Stream Description | | Interstage Drum Inlet | 2nd Stage Inlet | 2nd Stage Discharge | Accumulator Inlet | Accumulator Vapor |
| | | | | | | |
| Phase | | Mixed | Vapor | Vapor | Mixed | Vapor |
| | | | | | | |
| Temperature | C | 35.00 | 34.79 | 68.20 | 35.00 | 35.00 |
| Pressure | BAR | 16.51 | 16.51 | 27.88 | 27.40 | 27.40 |
| | | | | | | |
| Flowrate | KG-MOL/HR | 3,503.5 | 2,870.5 | 2,870.5 | 2,870.5 | 2,442.0 |
| Total Mass Rate | KG/HR | 128,829.6 | 95,329.7 | 95,329.7 | 95,329.7 | 74,449.1 |
| Total Molecular Weight | | 36.77 | 33.21 | 33.21 | 33.21 | 30.49 |
| | | | | | | |
| Composition | Mole% | | | | | |
| N2 | | 6.17 | 7.48 | 7.48 | 7.48 | 8.68 |
| METHANE | | 18.83 | 22.54 | 22.54 | 22.54 | 25.72 |
| C2H4 | | 32.96 | 38.53 | 38.53 | 38.53 | 42.50 |
| ETHANE | | 0.00 | 0.00 | 0.00 | 0.00 | 0.00 |
| C3 | | 11.83 | 11.35 | 11.35 | 11.35 | 10.13 |
| BUTANE | | 30.21 | 20.11 | 20.11 | 20.11 | 12.97 |
| **High/Low Ranges** | | | | | | |
| High Temperature | C | 50.00 | | 130.00 | 50.00 | |
| Low Temperature | C | -40.00 | | 40.00 | -40.00 | |
| High Pressure | BAR | 25.00 | | 72.00 | 72.00 | |
| Low Pressure | BAR | 8.00 | | 22.00 | 22.00 | |

FIG. 15B

| Stream Name | | 36 | 38 | 40 | 48 | 104A |
|---|---|---|---|---|---|---|
| **Stream Description** | | **Accumulator Liquid** | **Mid Boiling Refrigerant Inlet** | **Spillback** | **High Boiling Refrigerant Inlet** | **Low Pressure MR Vapor Outlet** |
| | | | | | | |
| Phase | | Liquid | Liquid | Liquid | Liquid | Vapor |
| | | | | | | |
| Temperature | C | 35.00 | 35.00 | 35.00 | 34.79 | 31.01 |
| Pressure | BAR | 27.40 | 27.40 | 27.40 | 16.51 | 4.50 |
| | | | | | | |
| Flowrate | KG-MOL/HR | 428.5 | 342.8 | 85.7 | 718.7 | 2,784.8 |
| Total Mass Rate | KG/HR | 20 ,880.6 | 16,704.5 | 4,176.1 | 37,676.0 | 91,153.6 |
| Total Molecular Weight | | 48.73 | 48.73 | 48.73 | 52.42 | 32.73 |
| | | | | | | |
| Composition | Mole% | | | | | |
| N2 | | 0.60 | 0.60 | 0.60 | 0.28 | 7.69 |
| METHANE | | 4.43 | 4.43 | 4.43 | 2.27 | 23.10 |
| C2H4 | | 15.89 | 15.89 | 15.89 | 8.71 | 39.22 |
| ETHANE | | 0.00 | 0.00 | 0.00 | 0.00 | 0.00 |
| C3 | | 18.31 | 18.31 | 18.31 | 14.54 | 11.13 |
| BUTANE | | 60.77 | 60.77 | 60.77 | 74.19 | 18.86 |
| **High/Low Ranges** | | | | | | |
| High Temperature | C | | | | | |
| Low Temperature | C | | | | | |
| High Pressure | BAR | | | | | |
| Low Pressure | BAR | | | | | |

FIG. 15C

| Stream Name | | 108A | 112 | 122 | 124 | 128 |
|---|---|---|---|---|---|---|
| Stream Description | | Low Pressure High Boiling Refrigerant Outlet | Subcooled Cold Separator Vapor | Low Pressure MR Inlet | Subcooled Mid Boiling Refrigerant | Subcooled Cold Separator Liquid |
| | | | | | | |
| Phase | | Mixed | Liquid | Mixed | Liquid | Liquid |
| | | | | | | |
| Temperature | C | 31.01 | -163.00 | -166.52 | -95.00 | -91.72 |
| Pressure | BAR | 4.50 | 27.20 | 4.80 | 27.20 | 27.20 |
| | | | | | | |
| Flowrate | KG-MOL/HR | 718.7 | 999.6 | 999.6 | 342.8 | 1,442.5 |
| Total Mass Rate | KG/HR | 37,676.0 | 23,204.5 | 23,204.5 | 16,704.5 | 51,244.6 |
| Total Molecular Weight | | 52.42 | 23.21 | 23.21 | 48.73 | 35.53 |
| | | | | | | |
| Composition | Mole% | | | | | |
| N2 | | 0.28 | 18.94 | 18.94 | 0.60 | 1.57 |
| METHANE | | 2.27 | 43.44 | 43.44 | 4.43 | 13.44 |
| C2H4 | | 8.71 | 35.72 | 35.72 | 15.89 | 47.20 |
| ETHANE | | 0.00 | 0.00 | 0.00 | 0.00 | 0.00 |
| C3 | | 14.54 | 1.32 | 1.32 | 18.31 | 16.23 |
| BUTANE | | 74.19 | 0.58 | 0.58 | 60.77 | 21.56 |
| **High/Low Ranges** | | | | | | |
| High Temperature | C | | -140.00 | -145.00 | -50.00 | -50.00 |
| Low Temperature | C | | -170.00 | -175.00 | -135.00 | -135.00 |
| High Pressure | BAR | | 72.00 | 12.00 | 72.00 | 72.00 |
| Low Pressure | BAR | | 22.00 | 2.00 | 22.00 | 22.00 |

FIG. 15D

| Stream Name | | 132 | 140 | 158 | 156 |
|---|---|---|---|---|---|
| Stream Description | | Low Pressure Mid Boiling Refrigerant Inlet | Subcooled High Boiling Refrigerant | Low Pressure High Boiling Refrigerant Outlet | Cold Separator Liquid |
| | | | | | |
| Phase | | Liquid | Liquid | Liquid | Liquid |
| | | | | | |
| Temperature | C | -93.97 | -65.00 | -64.49 | -39.00 |
| Pressure | BAR | 4.70 | 16.31 | 4.70 | 27.20 |
| | | | | | |
| Flowrate | KG-MOL/HR | 342.8 | 718.7 | 718.7 | 1,442.5 |
| Total Mass Rate | KG/HR | 16,704.5 | 37,676.0 | 37,676.0 | 51,244.6 |
| Total Molecular Weight | | 48.73 | 52.42 | 52.42 | 35.53 |
| | | | | | |
| Composition | Mole% | | | | |
| N2 | | 0.60 | 0.28 | 0.28 | 1.57 |
| METHANE | | 4.43 | 2.27 | 2.27 | 13.44 |
| C2H4 | | 15.89 | 8.71 | 8.71 | 47.20 |
| ETHANE | | 0.00 | 0.00 | 0.00 | 0.00 |
| C3 | | 18.31 | 14.54 | 14.54 | 16.23 |
| BUTANE | | 60.77 | 74.19 | 74.19 | 21.56 |
| **High/Low Ranges** | | | | | |
| High Temperature | C | -55.00 | -20.00 | -25.00 | |
| Low Temperature | C | -140.00 | -90.00 | -95.00 | |
| High Pressure | BAR | 12.00 | 25.00 | 12.00 | |
| Low Pressure | BAR | 2.00 | 8.00 | 2.00 | |

FIG. 15E

| Stream Name | | 160 | 164 |
|---|---|---|---|
| **Stream Description** | | **Cold Separator Vapor** | **Cold Separator Feed** |
| | | | |
| Phase | | Vapor | Mixed |
| | | | |
| Temperature | C | -39.00 | -39.00 |
| Pressure | BAR | 27.20 | 27.20 |
| | | | |
| Flowrate | KG-MOL/HR | 999.6 | 2,442.0 |
| Total Mass Rate | KG/HR | 23,204.5 | 74,449.1 |
| Total Molecular Weight | | 23.21 | 30.49 |
| | | | |
| Composition | Mole% | | |
| N2 | | 18.94 | 8.68 |
| METHANE | | 43.44 | 25.72 |
| C2H4 | | 35.72 | 42.50 |
| ETHANE | | 0.00 | 0.00 |
| C3 | | 1.32 | 10.13 |
| BUTANE | | 0.58 | 12.97 |
| **High/Low Ranges** | | | |
| High Temperature | C | | -20.00 |
| Low Temperature | C | | -80.00 |
| High Pressure | BAR | | 72.00 |
| Low Pressure | BAR | | 22.00 |

FIG. 15F

MIXED REFRIGERANT SYSTEM AND METHOD

RELATED APPLICATIONS

This application is a continuation-in-part of U.S. patent application Ser. No. 16/545,695, filed Aug. 20, 2019, which is a continuation-in-part of U.S. patent application Ser. No. 14/218,949, filed Mar. 18, 2014, which claims priority to U.S. Provisional Patent Application No. 61/802,350, filed Mar. 15, 2013, the entire contents of each of which are hereby incorporated by reference.

FIELD OF THE INVENTION

The present invention generally relates to mixed refrigerant systems and methods suitable for cooling fluids such as natural gas.

BACKGROUND

Natural gas and other gases are liquefied for storage and transport. Liquefaction reduces the volume of the gas and is typically carried out by chilling the gas through indirect heat exchange in one or more refrigeration cycles. The refrigeration cycles are costly because of the complexity of the equipment and the performance efficiency of the cycle. There is a need, therefore, for gas cooling and/or liquefaction systems that are less complex, more efficient, and less expensive to operate.

Liquefying natural gas, which is primarily methane, typically requires cooling the gas stream to approximately −160° C. to −170° C. and then letting down the pressure to approximately atmospheric. Typical temperature-enthalpy curves for liquefying gaseous methane, such as shown in FIG. 1 (methane at 60 bar pressure, methane at 35 bar pressure, and a methane/ethane mixture at 35 bar pressure), have three regions along an S-shaped curve. As the gas is cooled, at temperatures above about −75° C. the gas is de-superheating; and at temperatures below about −90° C. the liquid is subcooling. Between these temperatures, a relatively flat region is observed in which the gas is condensing into liquid. In the 60 bar methane curve, because the gas is above the critical pressure, only one phase is present above the critical temperature, but its specific heat is large near the critical temperature; below the critical temperature the cooling curve is similar to the lower pressure (35 bar) curves. The 35 bar curve for 95% methane/5% ethane shows the effect of impurities, which round off the dew and bubble points.

Refrigeration processes supply the requisite cooling for liquefying natural gas, and the most efficient of these have heating curves that closely approach the cooling curves in FIG. 1, ideally to within a few degrees throughout the entire temperature range. However, because of the S-shaped form of the cooling curves and the large temperature range, such refrigeration processes are difficult to design. Pure component refrigerant processes, because of their flat vaporization curves, work best in the two-phase region. Multi-component refrigerant processes, on the other hand, have sloping vaporization curves and are more appropriate for the de-superheating and subcooling regions. Both types of processes, and hybrids of the two, have been developed for liquefying natural gas.

Cascaded, multilevel, pure component refrigeration cycles were initially used with refrigerants such as propylene, ethylene, methane, and nitrogen. With enough levels, such cycles can generate a net heating curve that approximates the cooling curves shown in FIG. 1. However, as the number of levels increases, additional compressor trains are required, which undesirably adds to the mechanical complexity. Further, such processes are thermodynamically inefficient because the pure component refrigerants vaporize at constant temperature instead of following the natural gas cooling curve, and the refrigeration valve irreversibly flashes the liquid into vapor. For these reasons, mixed refrigerant processes have become popular to reduce capital costs and energy consumption and to improve operability.

U.S. Pat. No. 5,746,066 to Manley describes a cascaded, multilevel, mixed refrigerant process for ethylene recovery, which eliminates the thermodynamic inefficiencies of the cascaded multilevel pure component process. This is because the refrigerants vaporize at rising temperatures following the gas cooling curve, and the liquid refrigerant is subcooled before flashing thus reducing thermodynamic irreversibility. Mechanical complexity is somewhat reduced because fewer refrigerant cycles are required compared to pure refrigerant processes. See, e.g., U.S. Pat. No. 4,525,185 to Newton; U.S. Pat. No. 4,545,795 to Liu et al.; U.S. Pat. No. 4,689,063 to Paradowski et al.; and U.S. Pat. No. 6,041,619 to Fischer et al.; and U.S. Patent Application Publication Nos. 2007/0227185 to Stone et al. and 2007/0283718 to Hulsey et al.

The cascaded, multilevel, mixed refrigerant process is among the most efficient known, but a simpler, more efficient process, which can be more easily operated, is desirable.

A single mixed refrigerant process, which requires only one compressor for refrigeration and which further reduces the mechanical complexity has been developed. See, e.g., U.S. Pat. No. 4,033,735 to Swenson. However, for primarily two reasons, this process consumes somewhat more power than the cascaded, multilevel, mixed refrigerant processes discussed above.

First, it is difficult, if not impossible, to find a single mixed refrigerant composition that generates a net heating curve that closely approximates the typical natural gas cooling curve. Such a refrigerant requires a range of relatively high and low boiling components, whose boiling temperatures are thermodynamically constrained by the phase equilibrium. Higher boiling components are further limited in order to avoid their freezing out at low temperatures. The undesirable result is that relatively large temperature differences necessarily occur at several points in the cooling process, which is inefficient in the context of power consumption.

Second, in single mixed refrigerant processes, all of the refrigerant components are carried to the lowest temperature even though the higher boiling components provide refrigeration only at the warmer end of the process. The undesirable result is that energy must be expended to cool and reheat those components that are "inert" at the lower temperatures. This is not the case with either the cascaded, multilevel, pure component refrigeration process or the cascaded, multilevel, mixed refrigerant process.

To mitigate this second inefficiency and also address the first, numerous solutions have been developed that separate a heavier fraction from a single mixed refrigerant, use the heavier fraction at the higher temperature levels of refrigeration, and then recombine the heavier fraction with the lighter fraction for subsequent compression. See, e.g., U.S. Pat. No. 2,041,725 to Podbielniak; U.S. Pat. No. 3,364,685 to Perret; U.S. Pat. No. 4,057,972 to Sarsten; U.S. Pat. No. 4,274,849 to Garrier et al.; U.S. Pat. No. 4,901,533 to Fan et al.; U.S. Pat. No. 5,644,931 to Ueno et al.; U.S. Pat. No.

5,813,250 to Ueno et al; U.S. Pat. No. 6,065,305 to Arman et al., and U.S. Pat. No. 6,347,531 to Roberts et al.; and U.S. Patent Application Publication No. 2009/0205366 to Schmidt. With careful design, these processes can improve energy efficiency even though the recombining of streams not at equilibrium is thermodynamically inefficient. This is because the light and heavy fractions are separated at high pressure and then recombined at low pressure so that they may be compressed together in a single compressor. Generally, when streams are separated at equilibrium, separately processed, and then recombined at non-equilibrium conditions, a thermodynamic loss occurs, which ultimately increases power consumption. Therefore the number of such separations should be minimized. All of these processes use simple vapor/liquid equilibrium at various places in the refrigeration process to separate a heavier fraction from a lighter one.

Simple one-stage vapor/liquid equilibrium separation, however, doesn't concentrate the fractions as much as using multiple equilibrium stages with reflux. Greater concentration allows greater precision in isolating a composition that provides refrigeration over a specific range of temperatures. This enhances the process ability to follow the typical gas cooling curves. U.S. Pat. No. 4,586,942 to Gauthier and U.S. Pat. No. 6,334,334 to Stockmann et al (the latter marketed by Linde as the LIMUM®3 process) describe how fractionation may be employed in the above ambient compressor train to further concentrate the separated fractions used for refrigeration in different temperature zones and thus improve the overall process thermodynamic efficiency. A second reason for concentrating the fractions and reducing their temperature range of vaporization is to ensure that they are completely vaporized when they leave the refrigerated part of the process. This fully utilizes the latent heat of the refrigerant and precludes the entrainment of liquids into downstream compressors. For this same reason heavy fraction liquids are normally re-injected into the lighter fraction of the refrigerant as part of the process. Fractionation of the heavy fractions reduces flashing upon re-injection and improves the mechanical distribution of the two phase fluids.

As illustrated by U.S. Patent Application Publication No. 2007/0227185 to Stone et al., it is known to remove partially vaporized refrigeration streams from the refrigerated portion of the process. Stone et al. does this for mechanical (and not thermodynamic) reasons and in the context of a cascaded, multilevel, mixed refrigerant process that requires two separate mixed refrigerants. The partially vaporized refrigeration streams are completely vaporized upon recombination with their previously separated vapor fractions immediately prior to compression.

Multi-stream, mixed refrigerant systems are known in which simple equilibrium separation of a heavy fraction was found to significantly improve the mixed refrigerant process efficiency if that heavy fraction isn't entirely vaporized as it leaves the primary heat exchanger. See, e.g., U.S. Patent Application Publication No. 2011/0226008 to Gushanas et al. Liquid refrigerant, if present at the compressor suction, must be separated beforehand and sometimes pumped to a higher pressure. When the liquid refrigerant is mixed with the vaporized lighter fraction of the refrigerant, the compressor suction gas is cooled, which further reduces the power required. Heavy components of the refrigerant are kept out of the cold end of the heat exchanger, which reduces the possibility of refrigerant freezing. Also, equilibrium separation of the heavy fraction during an intermediate stage reduces the load on the second or higher stage compressor(s), which improves process efficiency. Use of the heavy fraction in an independent pre-cool refrigeration loop can result in a near closure of the heating/cooling curves at the warm end of the heat exchanger, which results in more efficient refrigeration.

"Cold vapor" separation has been used to fractionate high pressure vapor into liquid and vapor streams. See, e.g., U.S. Pat. No. 6,334,334 to Stockmann et al., discussed above; "State of the Art LNG Technology in China", Lange, M., 5$^{th}$ Asia LNG Summit, Oct. 14, 2010; "Cryogenic Mixed Refrigerant Processes", International Cryogenics Monograph Series, Venkatarathnam, G., Springer, pp 199-205; and "Efficiency of Mid Scale LNG Processes Under Different Operating Conditions", Bauer, H., Linde Engineering. In another process, marketed by Air Products as the AP-SMR™ LNG process, a "warm", mixed refrigerant vapor is separated into cold mixed refrigerant liquid and vapor streams. See, e.g., "Innovations in Natural Gas Liquefaction Technology for Future LNG Plants and Floating LNG Facilities", International Gas Union Research Conference 2011, Bukowski, J. et al. In these processes, the thus-separated cold liquid is used as the middle temperature refrigerant by itself and remains separate from the thus-separated cold vapor prior to joining a common return stream. The cold liquid and vapor streams, together with the rest of the returning refrigerants, are recombined via cascade and exit together from the bottom of the heat exchanger.

In the vapor separation systems discussed above, the warm temperature refrigeration used to partially condense the liquid in the cold vapor separator is produced by the liquid from the high-pressure accumulator. The present inventors have found that this requires higher pressure and less than ideal temperatures, both of which undesirably consume more power during operation.

Another process that uses cold vapor separation, albeit in a multi-stage, mixed refrigerant system, is described in GB Pat. No. 2,326,464 to Costain Oil. In this system, vapor from a separate reflux heat exchanger is partially condensed and separated into liquid and vapor streams. The thus-separated liquid and vapor streams are cooled and separately flashed before rejoining in a low-pressure return stream. Then, before exiting the main heat exchanger, the low-pressure return stream is combined with a subcooled and flashed liquid from the aforementioned reflux heat exchanger and then further combined with a subcooled and flashed liquid provided by a separation drum set between the compressor stages. In this system, the "cold vapor" separated liquid and the liquid from the aforementioned reflux heat exchanger are not combined prior to joining the low-pressure return stream. That is, they remain separate before independently joining up with the low-pressure return stream. As will be explained more fully below, the present inventors have found that power consumption can be significantly reduced by, inter alia, mixing a liquid obtained from a high-pressure accumulator with the cold vapor separated liquid prior to their joining a return stream.

BRIEF DESCRIPTION OF THE DRAWINGS

FIGS. 14A-14E show stream data for several embodiments of the invention and correlate with FIG. 6.

FIGS. 15A-15F show stream data for several embodiments of the invention and correlate with FIG. 7.

BRIEF SUMMARY

Figure 1:
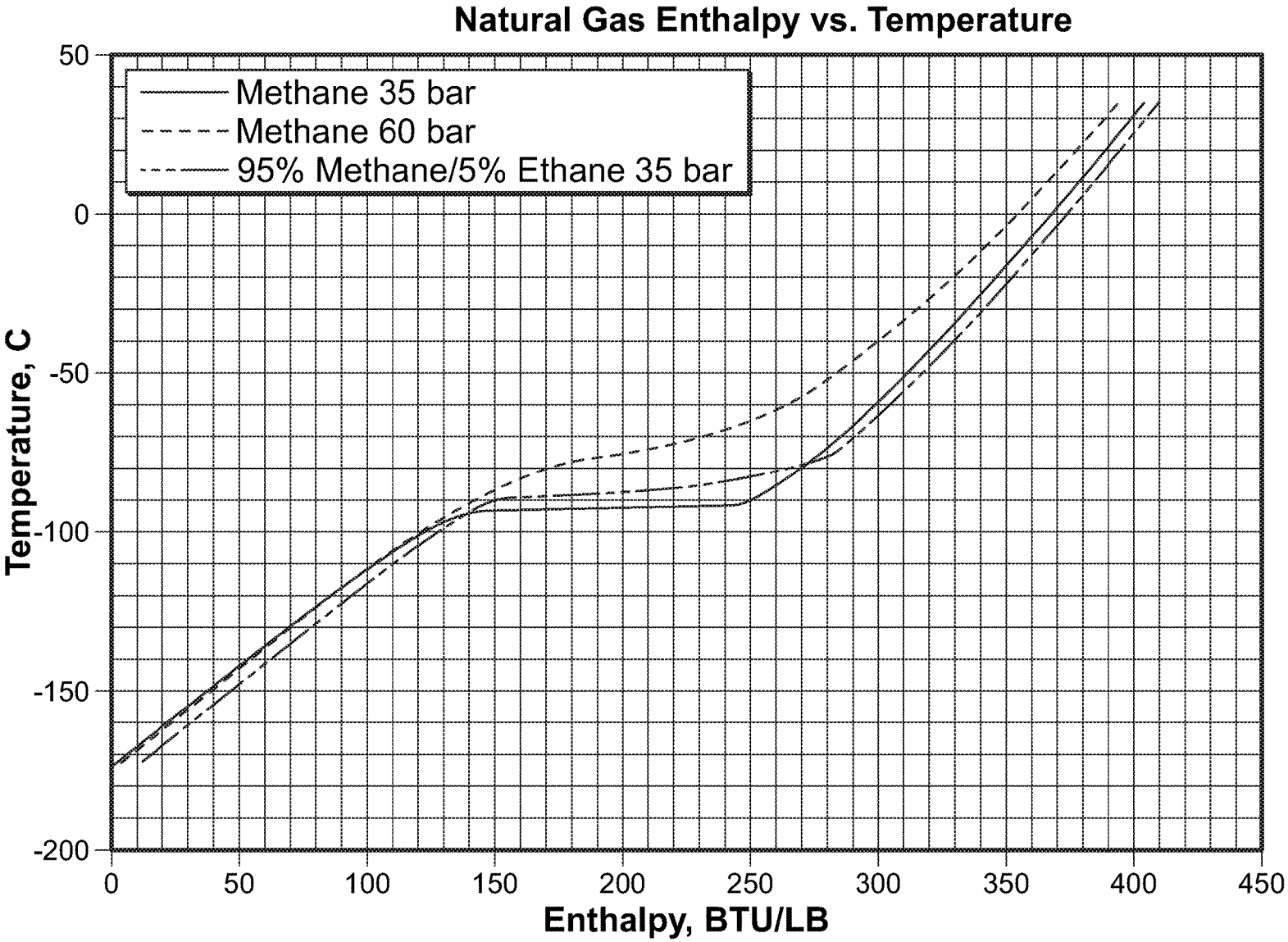
FIG. 1 is a graphical representation of temperature-enthalpy curves for methane and a methane-ethane mixture.

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for cooling a feed fluid with a mixed refrigerant includes a main heat exchanger including a warm end and a cold end with a feed fluid cooling passage extending therebetween, the feed fluid cooling passage being configured to receive a feed fluid at the warm end and to convey a cooled feed fluid out of the cold end. The main heat exchanger also includes a high pressure vapor passage, a high pressure liquid passage, a cold separator vapor cooling passage, a cold separator liquid cooling passage and a primary refrigeration passage. A mixed refrigerant compressor system includes a compressor configured to receive a vapor phase or mixed phase refrigerant return stream from the primary refrigeration passage of the heat exchanger, an aftercooler configured to receive a compressed refrigerant stream from the compressor and a high pressure separation device having an inlet in fluid communication with the aftercooler outlet and a high pressure liquid outlet and a high pressure vapor outlet. The high pressure vapor cooling passage of the heat exchanger is configured to receive a high pressure vapor stream from the high pressure vapor outlet of the high pressure separation device and to cool the high pressure vapor stream to form a mixed phase stream. A cold vapor separator is configured to receive the mixed phase stream from the high pressure vapor cooling passage of the heat exchanger and has a cold separator liquid outlet and a cold separator vapor outlet. The cold separator vapor cooling passage of the heat exchanger is configured to receive and condense a cold separator vapor stream from the vapor outlet of the cold vapor separator so that a condensed cold separator stream is formed. A first expansion device is configured to receive and expand the condensed cold separator stream from the cold separator vapor cooling passage of the heat exchanger so that a cold temperature refrigerant stream is formed. The high pressure liquid cooling passage of the heat exchanger has a first heat exchange passage length and is configured to receive and subcool at least a portion of a mid-boiling refrigerant liquid stream from the high pressure liquid outlet of the high pressure separation device so that a subcooled mid-boiling refrigerant liquid stream is formed. The cold separator liquid cooling passage of the heat exchanger has a second heat exchange passage length, where the first heat exchange passage is separate and distinct from the second heat exchange passage and the first heat exchange passage length is greater than the second heat exchange passage length. The cold separator liquid cooling passage is configured to receive and subcool a cold separator liquid stream from the cold separator liquid outlet so that a subcooled cold separator liquid stream is formed. A junction is configured to combine the subcooled mid-boiling refrigerant liquid stream and the subcooled cold separator liquid stream while the subcooled mid-boiling refrigerant liquid stream is at, or colder via expansion than, the temperature of the subcooled mid-boiling refrigerant liquid stream in the subcooled state and the subcooled cold separator liquid stream is at, or colder via expansion than, the temperature of the subcooled cold separator liquid stream in the subcooled state so that a middle temperature refrigerant stream is formed. The primary refrigeration passage of the heat exchanger is configured to receive the cold temperature refrigerant stream from the first expansion device and the middle temperature stream from the junction and to thermally contact a feed fluid in the feed fluid cooling passage of the heat exchanger to form a cooled feed fluid in the feed fluid cooling passage and a vapor phase or mixed phase refrigerant return stream in the primary refrigeration passage.

DESCRIPTION OF THE SEVERAL EMBODIMENTS

Figure 2:
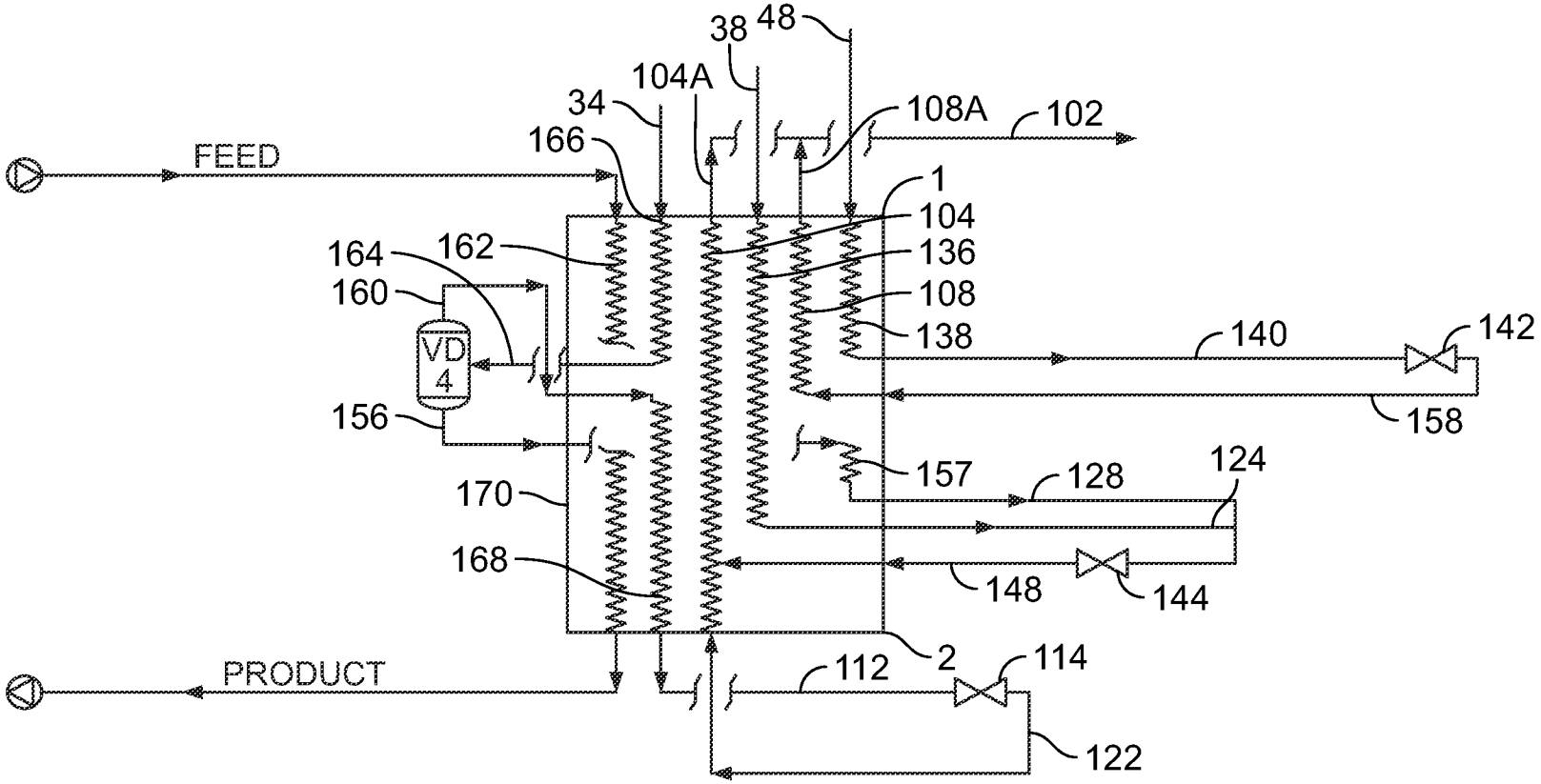
FIG. 2 is a process flow diagram and schematic illustrating an embodiment of a process and system of the invention.

A process flow diagram and schematic illustrating an embodiment of a multi-stream heat exchanger is provided in FIG. 2.

As illustrated in FIG. 2, one embodiment includes a multi-stream heat exchanger 170, having a warm end 1 and a cold end 2. The heat exchanger receives a feed fluid stream, such as a high pressure natural gas feed stream that is cooled and/or liquefied in cooling passage 162 via removal of heat via heat exchange with refrigeration streams in the heat exchanger. As a result, a stream of product fluid such as liquid natural gas is produced. The multi-stream design of the heat exchanger allows for convenient and energy-efficient integration of several streams into a single exchanger. Suitable heat exchangers may be purchased from Chart Energy & Chemicals, Inc. of The Woodlands, Tex. The plate and fin multi-stream heat exchanger available from Chart Energy & Chemicals, Inc. offers the further advantage of being physically compact.

In one embodiment, referring to FIG. 2, a feed fluid cooling passage 162 includes an inlet at the warm end 1 and a product outlet at the cold end 2 through which product exits the feed fluid cooling passage 162. A primary refrigeration passage 104 (or 204—see FIG. 3) has an inlet at the cold end for receiving a cold temperature refrigerant stream 122, a refrigerant return stream outlet at the warm end through which a vapor phase refrigerant return stream 104A exits the primary refrigeration passage 104, and an inlet adapted to receive a middle temperature refrigerant stream 148. In the heat exchanger, at the latter inlet, the primary refrigeration passage 104/204 is joined by the middle temperature refrigerant passage 148, where the cold temperature refrigerant stream 122 and the middle temperature refrigerant stream 148 combine. In one embodiment, the combination of the middle temperature refrigerant stream and the cold temperature refrigerant stream forms a middle temperature zone in the heat exchanger generally from the point at which they combine and downstream from there in the direction of the refrigerant flow toward the primary refrigerant outlet.

It should be noted herein that the passages and streams are sometimes both referred to by the same element number set out in the figures. Also, as used herein, and as known in the art, a heat exchanger is that device or an area in the device wherein indirect heat exchange occurs between two or more streams at different temperatures, or between a stream and the environment. As used herein, the terms "communication", "communicating", and the like generally refer to fluid communication unless otherwise specified. And although two fluids in communication may exchange heat upon mixing, such an exchange would not be considered to be the same as heat exchange in a heat exchanger, although such an exchange can take place in a heat exchanger. A heat exchange system can include those items though not specifically described are generally known in the art to be part of a heat exchanger, such as expansion devices, flash valves, and the like. As used herein, the term "reducing the pressure of" does not involve a phase change, while the term, "flashing", does involve a phase change, including even a partial phase change. As used herein, the terms, "high", "middle", "warm" and the like are relative to comparable streams, as is customary in the art. The stream tables of FIGS. 14A-14E and 15A-15F set out exemplary values as guidance, which are not intended to be limiting unless otherwise specified.

In an embodiment, the heat exchanger includes a high pressure vapor passage 166 adapted to receive a high pressure vapor stream 34 at the warm end and to cool the high pressure vapor stream 34 to form a mixed phase cold separator feed stream 164, and including an outlet in communication with a cold vapor separator VD4, the cold vapor separator VD4 adapted to separate the cold separator feed stream 164 into a cold separator vapor stream 160 and a cold separator liquid stream 156. In one embodiment, the high pressure vapor 34 is received from a high pressure accumulator separation device on the compression side.

In an embodiment, the heat exchanger includes a cold separator vapor passage having an inlet in communication with the cold vapor separator VD4. The cold separator vapor is cooled passage 168 condensed into liquid stream 112, and then flashed with 114 to form the cold temperature refrigerant stream 122. The cold temperature refrigerant 122 then enters the primary refrigeration passage at the cold end thereof. In one embodiment, the cold temperature refrigerant is a mixed phase.

In an embodiment, the cold separator liquid 156 is cooled in passage 157 to form subcooled cold vapor separator liquid 128. This stream can join the subcooled mid-boiling refrigerant liquid 124, discussed below, which, thus combined, are then flashed at 144 to form the middle temperature refrigerant 148, such as shown in FIG. 2. In one embodiment, the middle temperature refrigerant is a mixed phase.

In an embodiment, the heat exchanger includes a high pressure liquid passage 136. In one embodiment, the high pressure liquid passage receives a high pressure liquid 38 from a high pressure accumulator separation device on the compression side. In one embodiment, the high pressure liquid 38 is a mid-boiling refrigerant liquid stream. The high pressure liquid stream enters the warm end and is cooled to form a subcooled refrigerant liquid stream 124. As noted above, the subcooled cold separator liquid stream 128 is combined with the subcooled refrigerant liquid stream 124 to form a middle temperature refrigerant stream 148. In an embodiment, the one or both refrigerant liquids 124 and 128 can independently be flashed at 126 and 130 before combining into the middle temperature refrigerant 148, as shown for example in FIG. 4.

In an embodiment, the cold temperature refrigerant 122 and middle temperature refrigerant 148, thus combined, provide refrigeration in the primary refrigeration passage 104, where they exit as a vapor phase or mixed phase refrigerant return stream 104A/102. In an embodiment, they exit as a vapor phase refrigerant return stream 104A/102. In one embodiment, the vapor is a superheated vapor refrigerant return stream.

As shown in FIG. 2, the heat exchanger may also include a pre-cool passage adapted to receive a high-boiling refrigerant liquid stream 48 at the warm end. In one embodiment, the high-boiling refrigerant liquid stream 48 is provided by an interstage separation device between compressors on the compression side. The high-boiling liquid refrigerant stream 48 is cooled in pre-cool liquid passage 138 to form subcooled high-boiling liquid refrigerant 140. The subcooled high-boiling liquid refrigerant 140 is then flashed or has its pressure reduced at expansion device 142 to form the warm temperature refrigerant stream 158, which may be a mixed vapor liquid phase or liquid phase.

In an embodiment, the warm temperature refrigerant stream 158 enters the pre-cool refrigerant passage 108 to provide cooling. In an embodiment, the pre-cool refrigerant passage 108 provides substantial cooling for the high pressure vapor passage 166, for example, to cool and condense the high pressure vapor 34 into the mixed phase cold separator feed stream 164.

Figure 8:
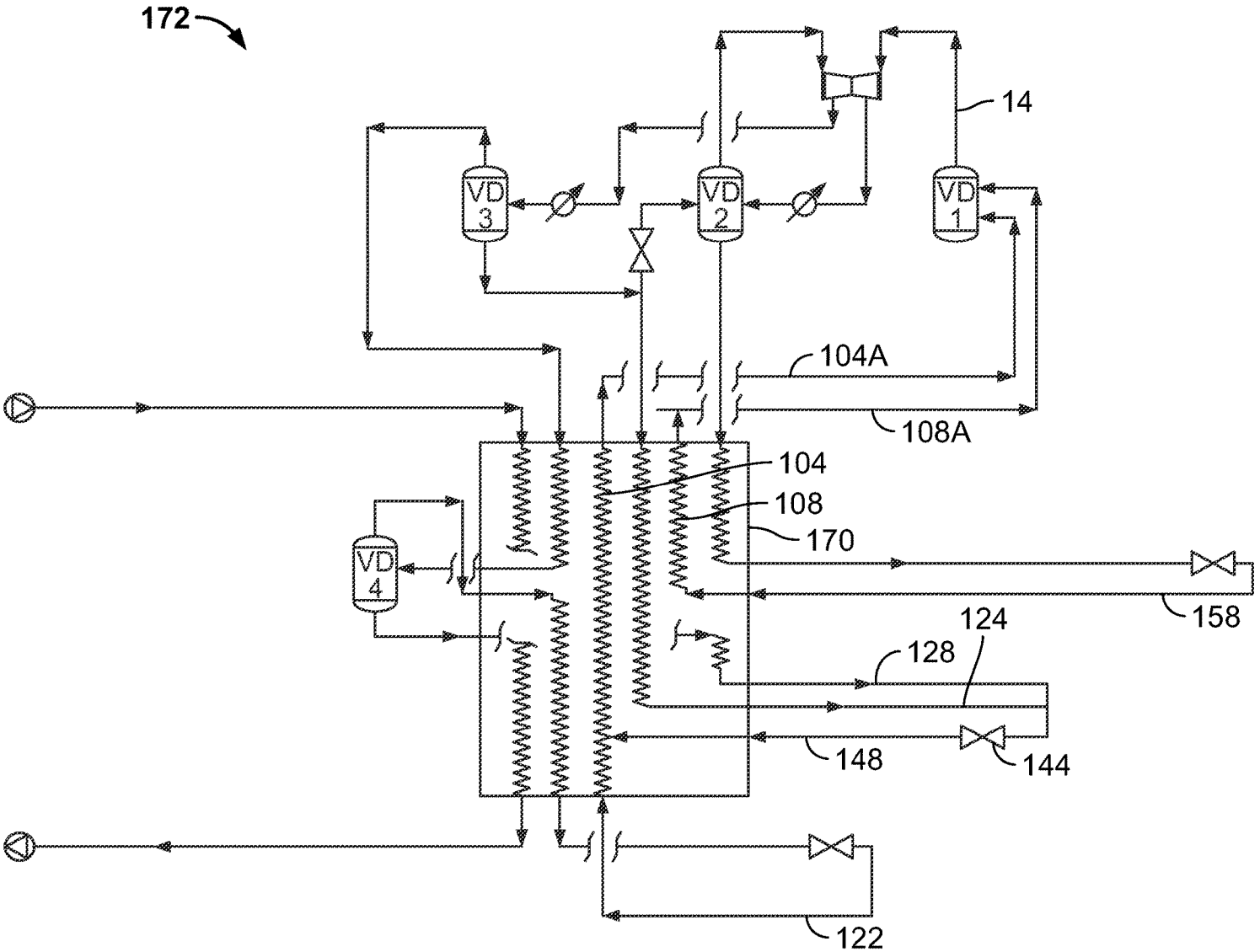
FIG. 8 is a process flow diagram and schematic illustrating a seventh embodiment of a process and system of the invention.

In an embodiment, the warm temperature refrigerant stream exits the pre-cool refrigeration passage 108 as a vapor phase or mixed phase warm temperature refrigerant return stream 108A. In an embodiment, the warm temperature refrigerant return stream 108A returns to the compression side either alone—such as shown in FIG. 8, or in combination with the refrigerant return stream 104A to form return stream 102. If combined, the return streams 108A and 104A can be combined with a mixing device. Examples of non-limiting mixing devices include but are not limited to static mixer, pipe segment, header of the heat exchanger, or combination thereof.

Figure 3:
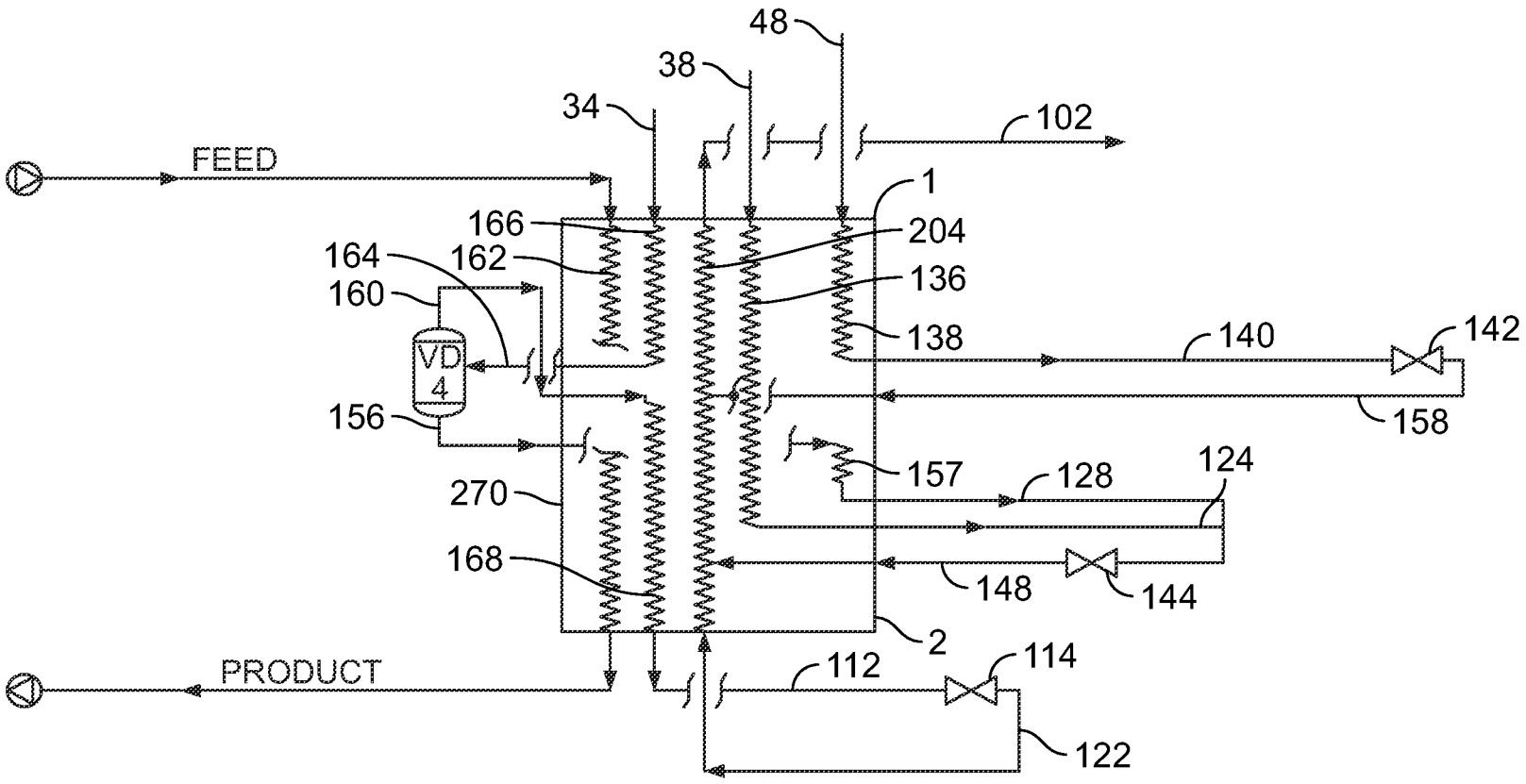
FIG. 3 is a process flow diagram and schematic illustrating a second embodiment of a process and system of the invention.

In an embodiment, the warm temperature refrigerant stream 158, rather than entering the pre-cool refrigerant passage 108, instead is introduced to the primary refrigerant passage 204, such as shown in FIG. 3. The primary refrigerant passage 204 includes an inlet downstream from the point where the middle temperature refrigerant 148 enters the primary refrigerant passage but upstream of the outlet for the return refrigerant stream 202. The cold temperature refrigerant stream 122, which was previously combined with the middle temperature refrigerant stream 148, and the warm temperature refrigerant stream 158 combine to provide warm temperature refrigeration in the corresponding area, e.g., between the refrigerant return stream outlet and the point of introduction of the warm temperature refrigerant 158 in the primary refrigeration passage 204. An example of this is shown in the heat exchanger 270 at FIG. 3. The combined refrigerants 122, 148, and 158 exit as a combined return refrigerant stream 202, which may be a mixed phase or a vapor phase. In an embodiment, the refrigerant return stream from the primary refrigeration passage 204 is a vapor phase return stream 202.

Figure 4:
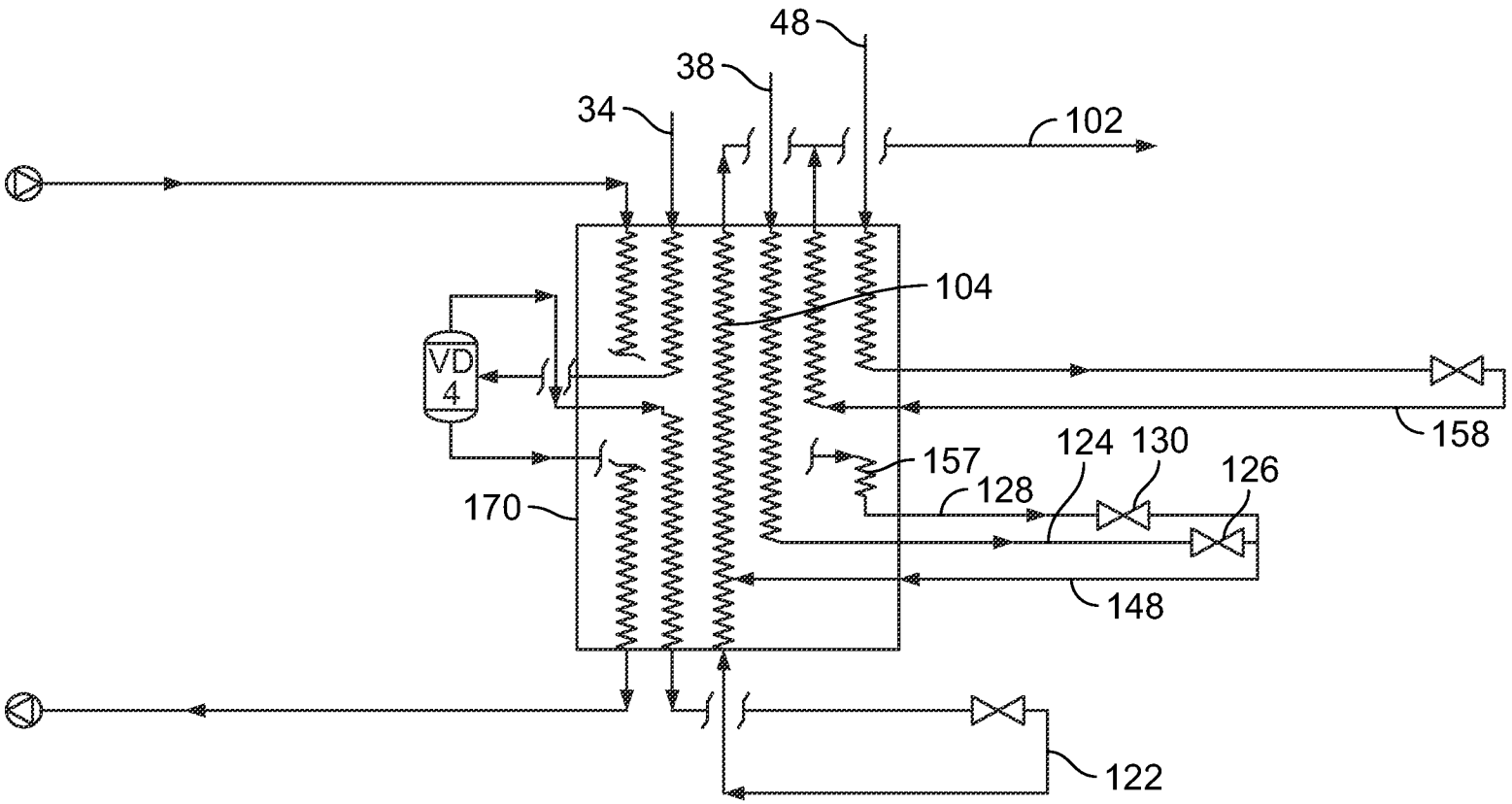
FIG. 4 is a process flow diagram and schematic illustrating a third embodiment of a process and system of the invention.
Figure 5:
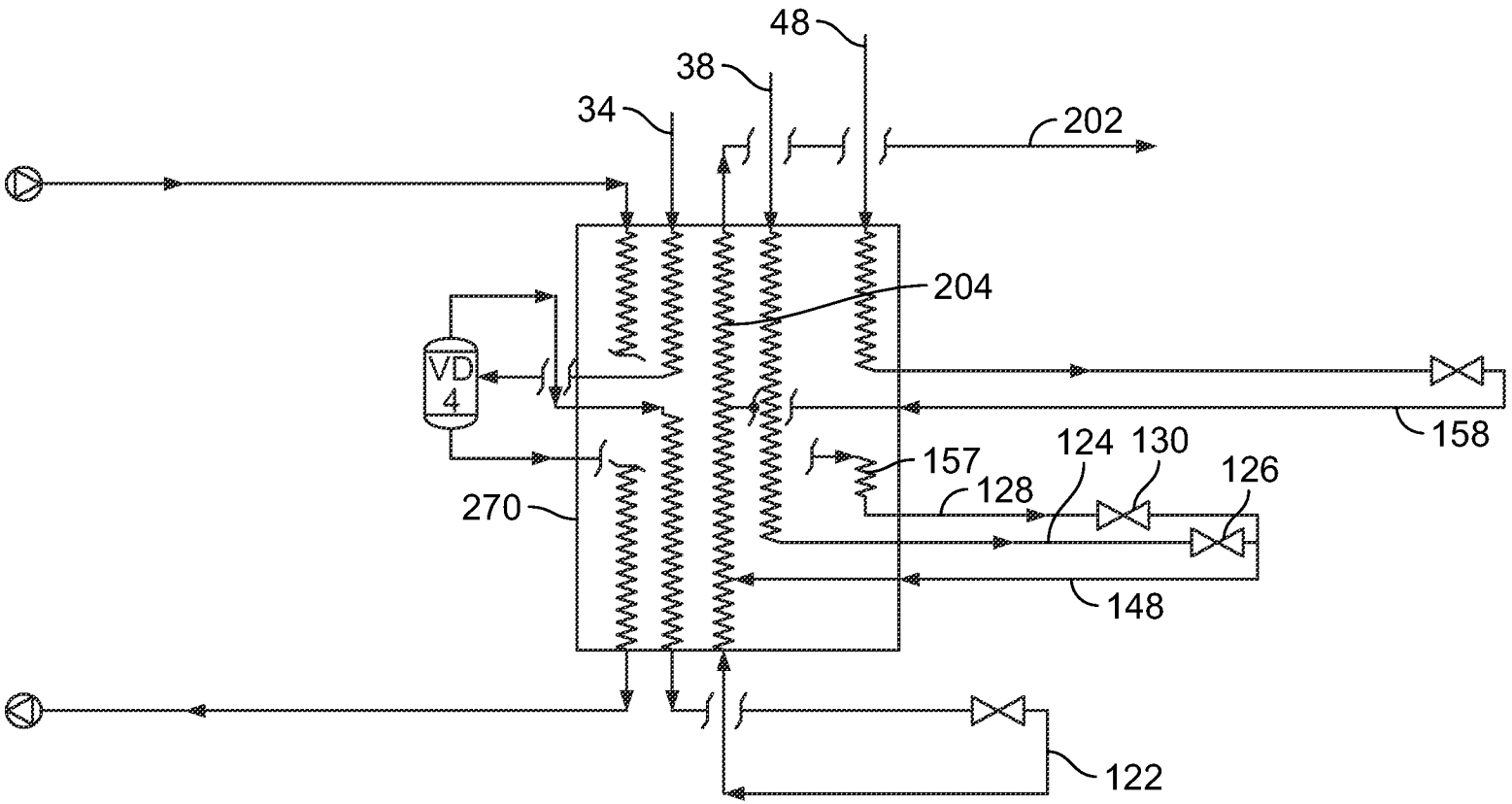
FIG. 5 is a process flow diagram and schematic illustrating a fourth embodiment of a process and system of the invention.

FIG. 5, like FIG. 4 discussed above, shows alternate arrangements for combining the subcooled cold separator liquid stream 128 and subcooled refrigerant liquid stream 124 to form the middle temperature refrigerant stream 148. In an embodiment, the one or both refrigerant liquids 124 and 128 can independently be flashed at 126 and 130 before combining into the middle temperature refrigerant 148.

Figure 6:
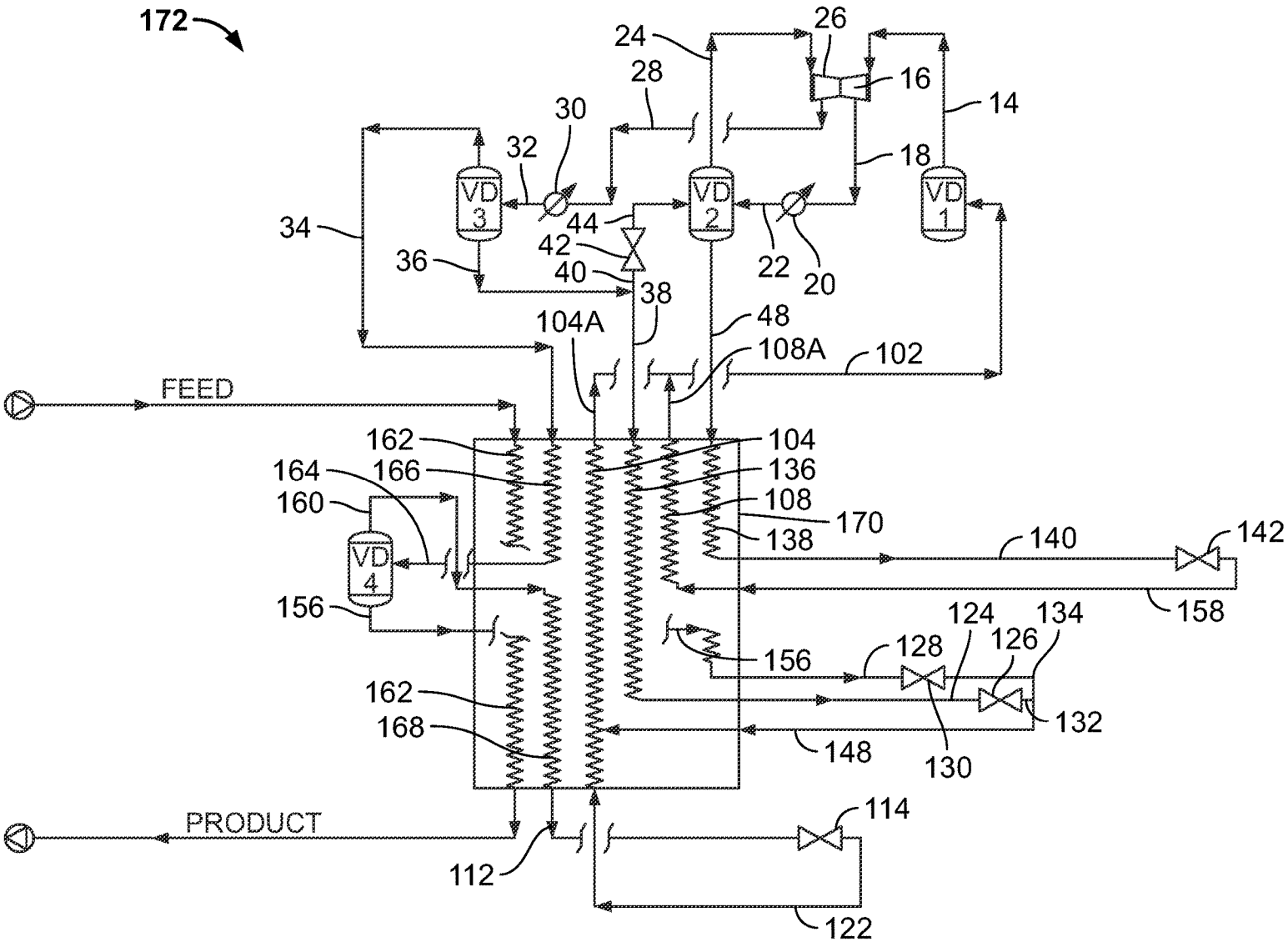
FIG. 6 is a process flow diagram and schematic illustrating a fifth embodiment of a process and system of the invention.
Figure 7:
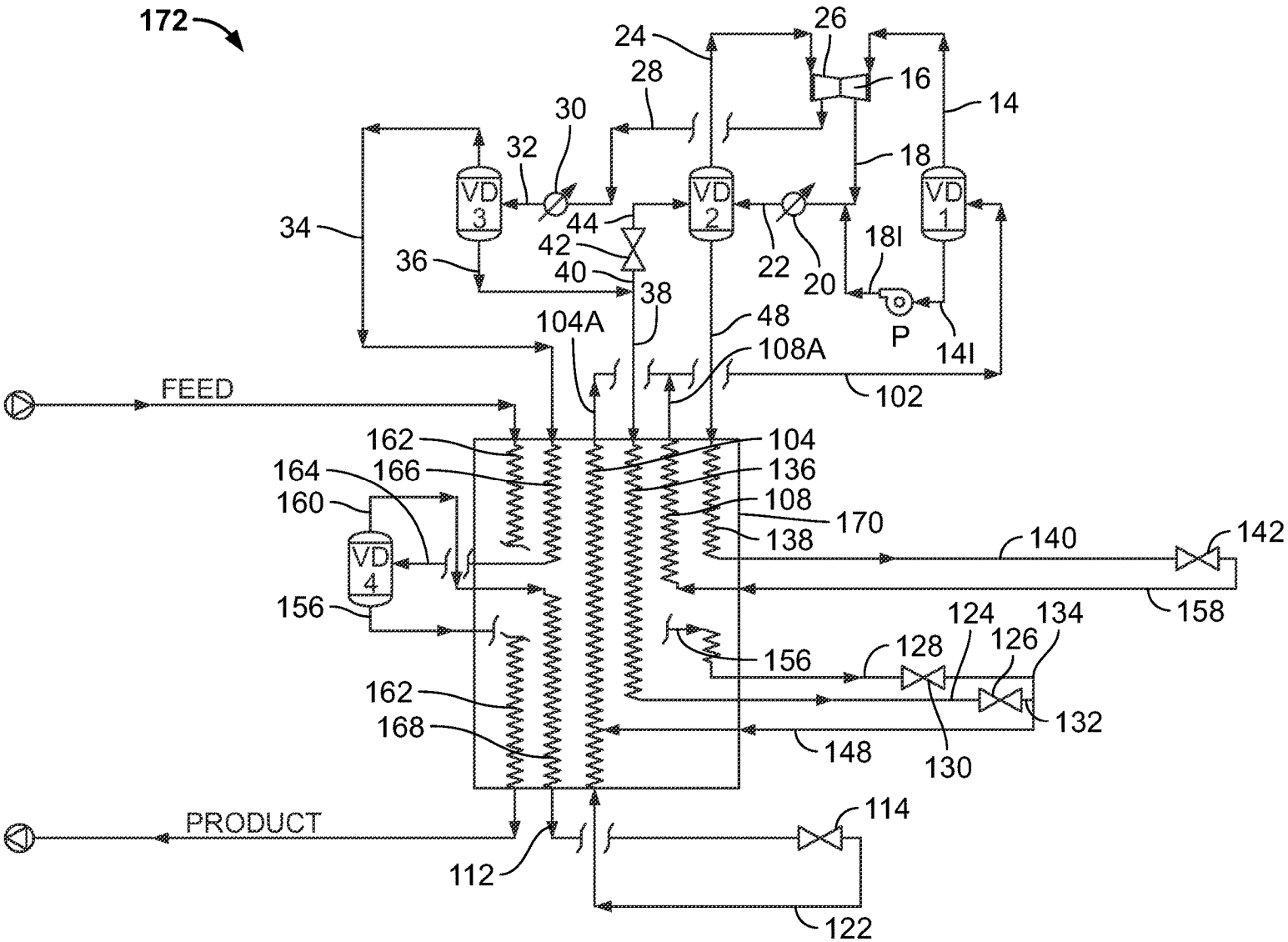
FIG. 7 is a process flow diagram and schematic illustrating a sixth embodiment of a process and system of the invention.

Referring to FIGS. 6 and 7, in which embodiments of a compression system, generally referenced as 172, are shown in combination with a heat exchanger, exemplified by 170. In an embodiment, the compression system is suitable for circulating a mixed refrigerant in a heat exchanger. Shown is a suction separation device VD1 having an inlet for receiving a low return refrigerant stream 102 (or 202, although not shown) and a vapor outlet and a vapor outlet 14. A compressor 16 is in fluid communication with the vapor outlet 14 and includes a compressed fluid outlet for providing a compressed fluid stream 18. An optional aftercooler 20 is shown for cooling the compressed fluid stream 18. If present, the aftercooler 20 provides a cooled fluid stream 22 to an interstage separation device VD2. The interstage separation device VD2 has a vapor outlet for providing a vapor stream 24 to the second stage compressor 26 and also a liquid outlet for providing a liquid stream 48 to the heat exchanger. In one embodiment the liquid stream 48 is a high-boiling refrigerant liquid stream.

Vapor stream 24 is provided to the compressor 26 via an inlet in communication with the interstage separation device VD2, which compresses the vapor 24 to provide compressed fluid stream 28. An optional aftercooler 30 if present cools the compressed fluid stream 28 to provide an a high pressure mixed phase stream 32 to the accumulator separation device VD3. The accumulator separation device VD3 separates the high pressure mixed phase stream 32 into high pressure vapor stream 34 and a high pressure liquid stream 36, which may be a mid-boiling refrigerant liquid stream. In an embodiment, the high pressure vapor stream 34 is sent to the high pressure vapor passage of the heat exchanger.

An optional splitting intersection is shown, which has an inlet for receiving the mid-high pressure liquid stream 36 from the accumulator separation device VD3, an outlet for providing a mid-boiling refrigerant liquid stream 38 to the heat exchanger, and optionally an outlet for providing a fluid stream 40 back to the interstage separation device VD2. An optional expansion device 42 for stream 40 is shown which, if present provides a an expanded cooled fluid stream 44 to the interstage separation device, the interstage separation device VD2 optionally further comprising an inlet for receiving the fluid stream 44. If the splitting intersection is not present, then the mid-boiling refrigerant liquid stream 36 is in direct fluid communication with mid-boiling refrigerant liquid stream 38.

FIG. 7 further includes an optional pump P, for pumping low pressure liquid refrigerant stream 14*l*, the temperature of which in one embodiment has been lowered by the flash cooling effect of mixing 108A and 104A before suction separation device VD1 for pumping forward to intermediate pressure. As described above, the outlet stream 18*l* from the pump travels to the interstage drum VD2.

Figure 9:
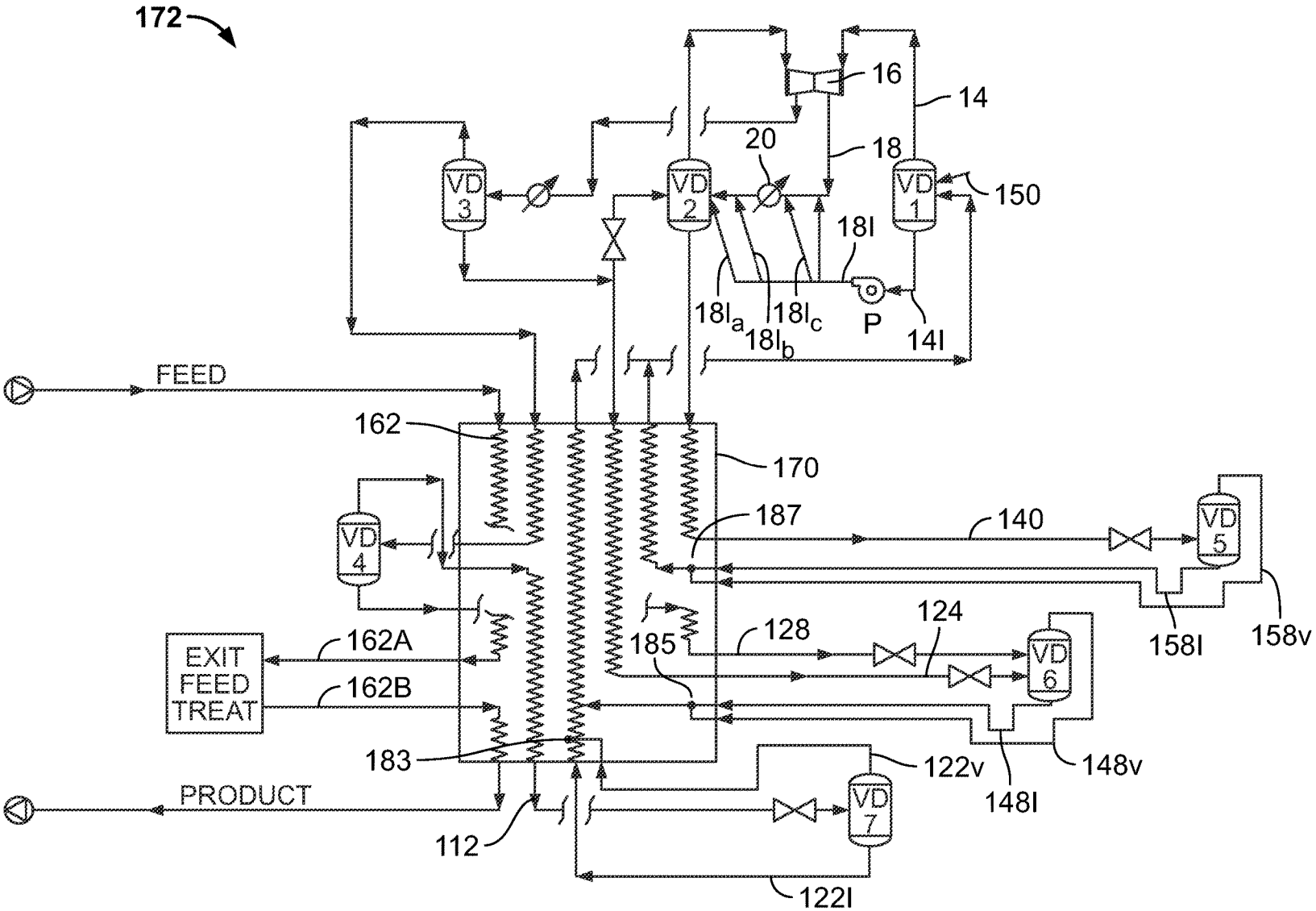
FIG. 9 is a process flow diagram and schematic illustrating an eighth embodiment of a process and system of the invention.
Figure 10:
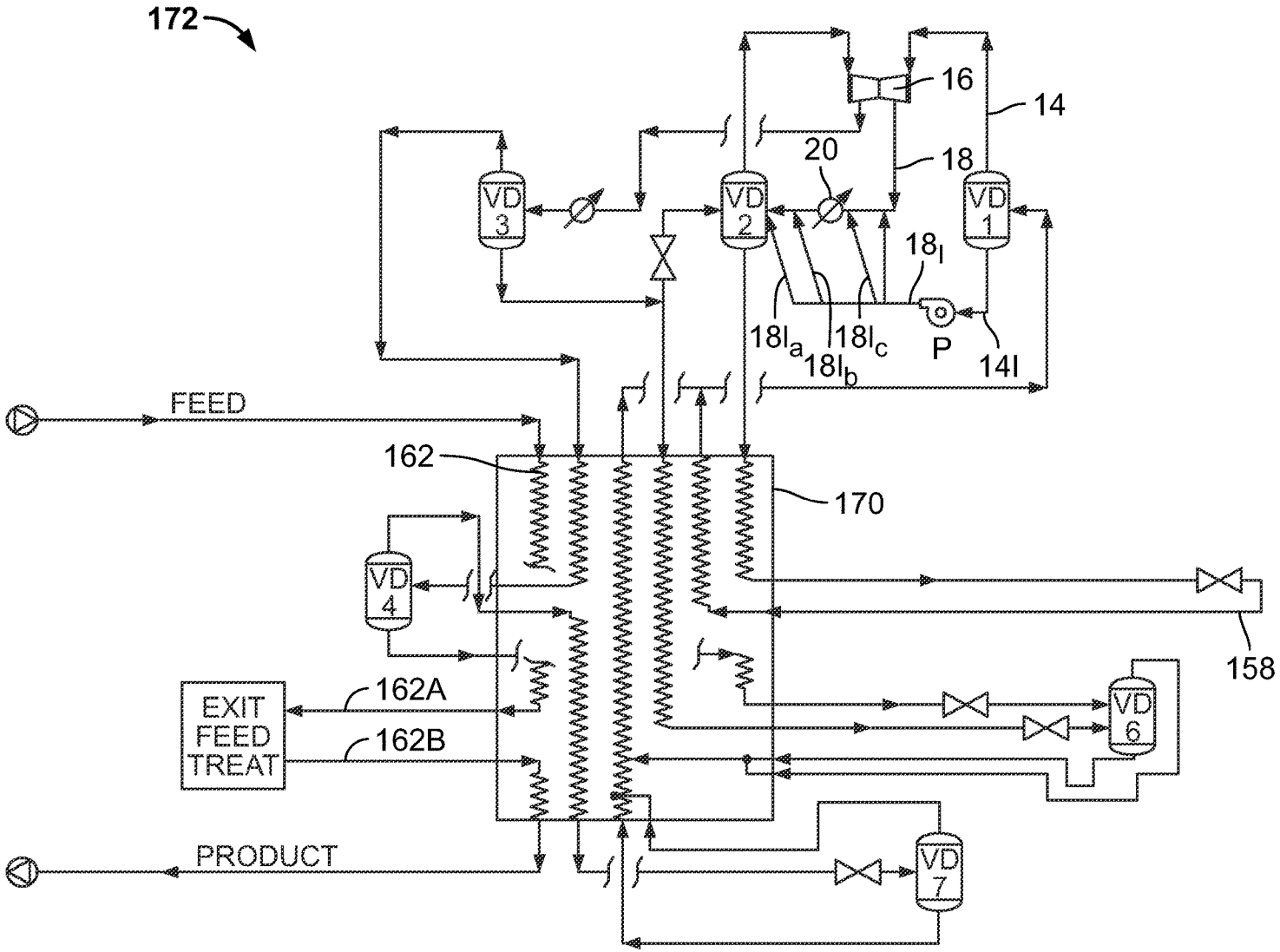
FIG. 10 is a process flow diagram and schematic illustrating a ninth embodiment of a process and system of the invention.
Figure 11:
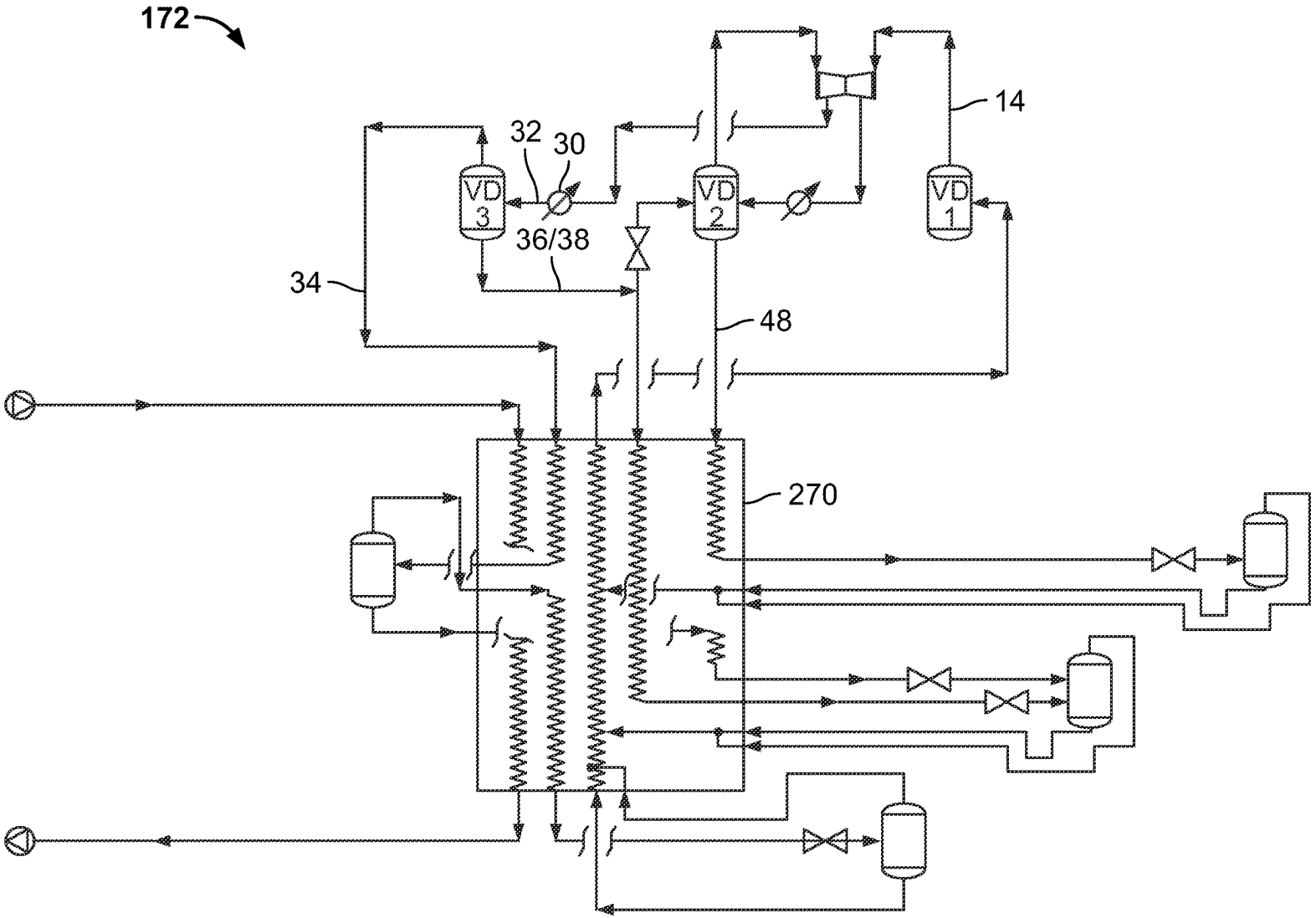
FIG. 11 is a process flow diagram and schematic illustrating a tenth embodiment of a process and system of the invention.
Figure 12:
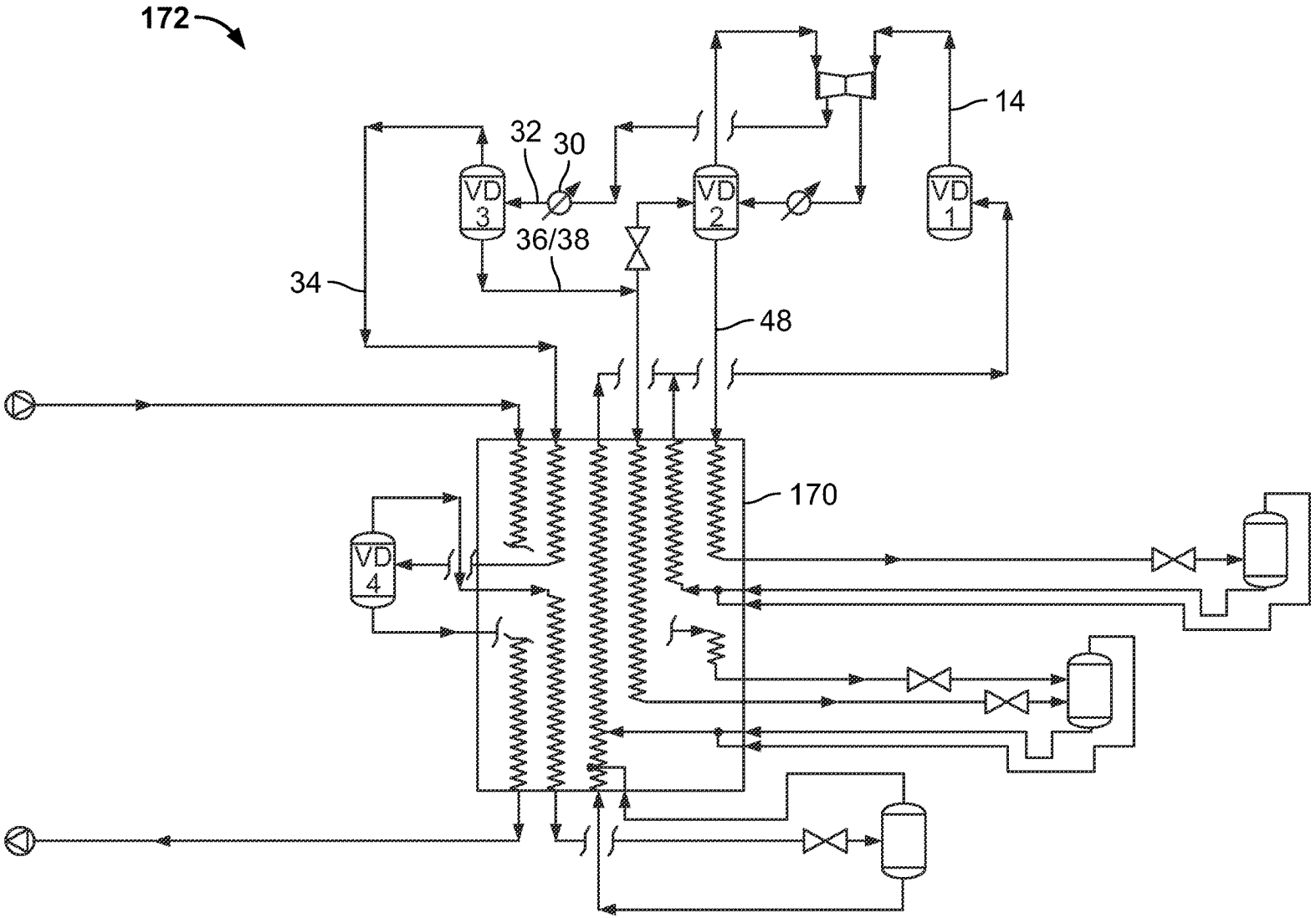
FIG. 12 is a process flow diagram and schematic illustrating an eleventh embodiment of a process and system of the invention.

FIG. 8 shows an example of different refrigerant return streams returning to suction separation device VD1. FIG. 9 shows several embodiments including feed fluid outlets and inlets 162A and 162B for external feed treatment, such as natural gas liquids recovery or nitrogen rejection, or the like.

Furthermore, while the present system and method are described below in terms of liquefaction of natural gas, they may be used for the cooling, liquefaction and/or processing of gases other than natural gas including, but not limited to, air or nitrogen.

The removal of heat is accomplished in the heat exchanger using a single mixed refrigerant in the systems described herein. Exemplary refrigerant compositions, conditions and flows of the streams of the refrigeration portion of the system, as described below, which are not intended to be limiting, are presented in FIGS. 14A-14E and 15A-15F.

In one embodiment, warm, high pressure, vapor refrigerant stream 34 is cooled, condensed and subcooled as it travels through high pressure vapor passage 166/168 of the heat exchanger 170. As a result, stream 112 exits the cold end of the heat exchanger 170. Stream 112 is flashed through expansion valve 114 and re-enters the heat exchanger as stream 122 to provide refrigeration as stream 104 traveling through primary refrigeration passage 104. As an alternative to the expansion valve 114, another type of expansion device could be used, including, but not limited to, a turbine or an orifice.

Warm, high pressure liquid refrigerant stream 38 enters the heat exchanger 170 and is subcooled in high pressure liquid passage 136. The resulting stream 124 exits the heat exchanger and is flashed through expansion valve 126. As an alternative to the expansion valve 126, another type of expansion device could be used, including, but not limited to, a turbine or an orifice. Significantly, the resulting stream 132 rather than re-entering the heat exchanger 170 directly to join the primary refrigeration passage 104, first joins the subcooled cold separator vapor liquid 128 to form a middle temperature refrigerant stream 148. The middle temperature refrigerant stream 148 then re-enters the heat exchanger wherein it joins the low pressure mixed phase stream 122 in primary refrigeration passage 104. Thus combined, and warmed, the refrigerants exit the warm end of the heat exchanger 170 as vapor refrigerant return stream 104A, which may be optionally superheated.

In one embodiment, vapor refrigerant return stream 104A and stream 108A which, may be mixed phase or vapor phase, may exit the warm end of the heat exchanger separately, e.g., each through a distinct outlet, or they may be combined within the heat exchanger and exit together, or they may exit the heat exchanger into a common header attached to the heat exchanger before returning to the suction separation device VD1. Alternatively, streams 104A and 108A may exit separately and remain so until combining in the suction separation device VD1, or they may, through vapor and mixed phase inlets, respectively, and are combined and equilibrated in the low pressure suction drum. While a suction drum VD1 is illustrated, alternative separation devices may be used, including, but not limited to, another type of vessel, a cyclonic separator, a distillation unit, a coalescing separator or mesh or vane type mist eliminator. As a result, a low pressure vapor refrigerant stream 14 exits the vapor outlet of drum VD1. As stated above, the stream 14 travels to the inlet of the first stage compressor 16. The blending of mixed phase stream 108A with stream 104A, which includes a vapor of greatly different composition, in the suction drum VD1 at the suction inlet of the compressor 16 creates a partial flash cooling effect that lowers the temperature of the vapor stream traveling to the compressor, and thus the compressor itself, and thus reduces the power required to operate it.

In one embodiment, a pre-cool refrigerant loop enters the warm side of the heat exchanger 170 and exits with a significant liquid fraction. The partially liquid stream 108A is combined with spent refrigerant vapor from stream 104A for equilibration and separation in suction drum VD1, compression of the resultant vapor in compressor 16 and pumping of the resulting liquid by pump P. In the present case, equilibrium is achieved as soon as mixing occurs, i.e., in the header, static mixer, or the like. In one embodiment, the drum merely protects the compressor. The equilibrium in suction drum VD1 reduces the temperature of the stream entering the compressor 16, by both heat and mass transfer, thus reducing the power usage by the compressor.

Other embodiments shown in FIG. 9 include various separation devices in the warm, middle, and cold refrigeration loops. In one embodiment, warm temperature refrigerant passage 158 is in fluid communication with a separation device.

In one embodiment, the warm temperature refrigerant passage 158 is in fluid communication with an accumulator separation device VD5 having a vapor outlet in fluid communication with a warm temperature refrigerant vapor passage 158*v* and a liquid outlet in fluid communication with a warm temperature refrigerant liquid passage 158*l*.

In one embodiment, the warm temperature refrigerant vapor and liquid passages 158*v* and 158*l* are in fluid communication with the low pressure high-boiling stream passage 108.

In one embodiment, the warm temperature refrigerant vapor and liquid passages 158*v* and 158*l* are in fluid communication with each other either inside the heat exchanger or in a header outside the heat exchanger.

In one embodiment, the flashed cold separator liquid stream passage 134 is in fluid communication with an accumulator separation device VD6 having a vapor outlet in fluid communication with a middle temperature refrigerant vapor passage 148*v*, and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream passage 132 is in fluid communication with an accumulator separation device VD6 having a vapor outlet in fluid communication with a middle temperature refrigerant vapor passage 148*v* and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream 132 and the flashed cold separator liquid stream 134 are in fluid communication with an accumulator separation device VD6 having a vapor outlet in fluid communication with a middle temperature refrigerant vapor passage 148*v* and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream 132 and the flashed cold separator liquid stream 134 are in fluid communication with each other prior to fluidly communicating with the accumulator separation device VD6.

In one embodiment, the low pressure mixed phase stream passage 122 is in fluid communication with an accumulator separation device VD7 having a vapor outlet in fluid communication with a cold temperature refrigerant vapor passage 122*v*, and a cold temperature liquid passage 122*l*.

In one embodiment, the cold temperature refrigerant vapor passage 122*v* and a cold temperature liquid passage 122*l* are in fluid communication with the low pressure mixed refrigerant passage 104.

In one embodiment, the cold temperature refrigerant vapor passage 122*v* and cold temperature liquid passage 122*l* are in fluid communication with each other either inside the heat exchanger or in a header outside the heat exchanger.

In one embodiment, each of the warm temperature refrigerant passage 158, flashed cold separator liquid stream passage 134, low pressure mid-boiling refrigerant passage 132, low pressure mixed phase stream passage 122 is in fluid communication with a separation device.

In one embodiment, one or more precooler may be present in series between elements 16 and VD2.

In one embodiment, one or more precooler may be present in series between elements 30 and VD3.

In one embodiment, a pump may be present between a liquid outlet of VD1 and the inlet of VD2. In some embodiments, a pump may be present between a liquid outlet of VD1 and having an outlet in fluid communication with elements 18 or 22.

In one embodiment, the pre-cooler is a propane, ammonia, propylene, ethane, pre-cooler.

In one embodiment, the pre-cooler features 1, 2, 3, or 4 multiple stages.

In one embodiment, the mixed refrigerant comprises 2, 3, 4, or 5 C1-C5 hydrocarbons and optionally N2.

In one embodiment, the suction separation device includes a liquid outlet and further comprising a pump having an inlet and an outlet, wherein the outlet of the suction separation device is in fluid communication with the inlet of the pump, and the outlet of the pump is in fluid communication with the outlet of the aftercooler.

In one embodiment, the mixed refrigerant system a further comprising a pre-cooler in series between the outlet of the intercooler and the inlet of the interstage separation device and wherein the outlet of the pump is also in fluid communication with the pre-cooler.

In one embodiment, the suction separation device is a heavy component refrigerant accumulator whereby vaporized refrigerant traveling to the inlet of the compressor is maintained generally at a dew point.

In one embodiment, the high pressure accumulator is a drum.

In one embodiment, an interstage drum is not present between the suction separation device and the accumulator separation device.

In one embodiment, the first and second expansion devices are the only expansion devices in closed-loop communication with the main process heat exchanger.

In one embodiment, an aftercooler is the only aftercooler present between the suction separation device and the accumulator separation device.

In one embodiment, the heat exchanger does not have a separate outlet for a pre-cool refrigeration passage.

In an alternative embodiment, described below with reference to FIG. 13, the technology of the disclosure may advantageously be used to provide cooling for an acid gas distillation process and system.

A conventional cascade refrigeration layout for acid gas distillation units has several issues, including high operating power and a high equipment count. The latter leads to higher capital expenditures and a larger plot space requirement. When applying the technology of the disclosure as a refrigeration system for an acid gas distillation unit, the refrigeration equipment count is significantly reduced. The multiple pure component refrigeration loops with multiple compression stages associated with a cascade refrigeration layout are replaced with a single mixed refrigerant loop with preferably a two-stage compressor. The use of a mixed refrigerant system and associated brazed aluminum heat exchangers (BAHX) also allows for additional process heating and cooling loads from the acid gas distillation unit to be integrated with the refrigeration system. This results in a further reduction in the total equipment count, and the required refrigeration flow/duty. This provides a significant reduction in operating power, and a reduction in the size of the refrigerant compressor and associated equipment.

An example of a cryogenic acid gas distillation system and process suitable for use with the technology of the disclosure is described in U.S. Pat. No. 9,945,605 to Pellegrini, issued Apr. 17, 2018, the contents of which is hereby incorporated by reference. The system and process disclosed by the Pellegrini '605 patent requires an external refrigeration source to generate the reflux for one or more distillation columns. This external refrigeration requirement can be met with a single mixed refrigerant system, such as the system indicated in general at 310 in FIG. 13.

Figure 13:
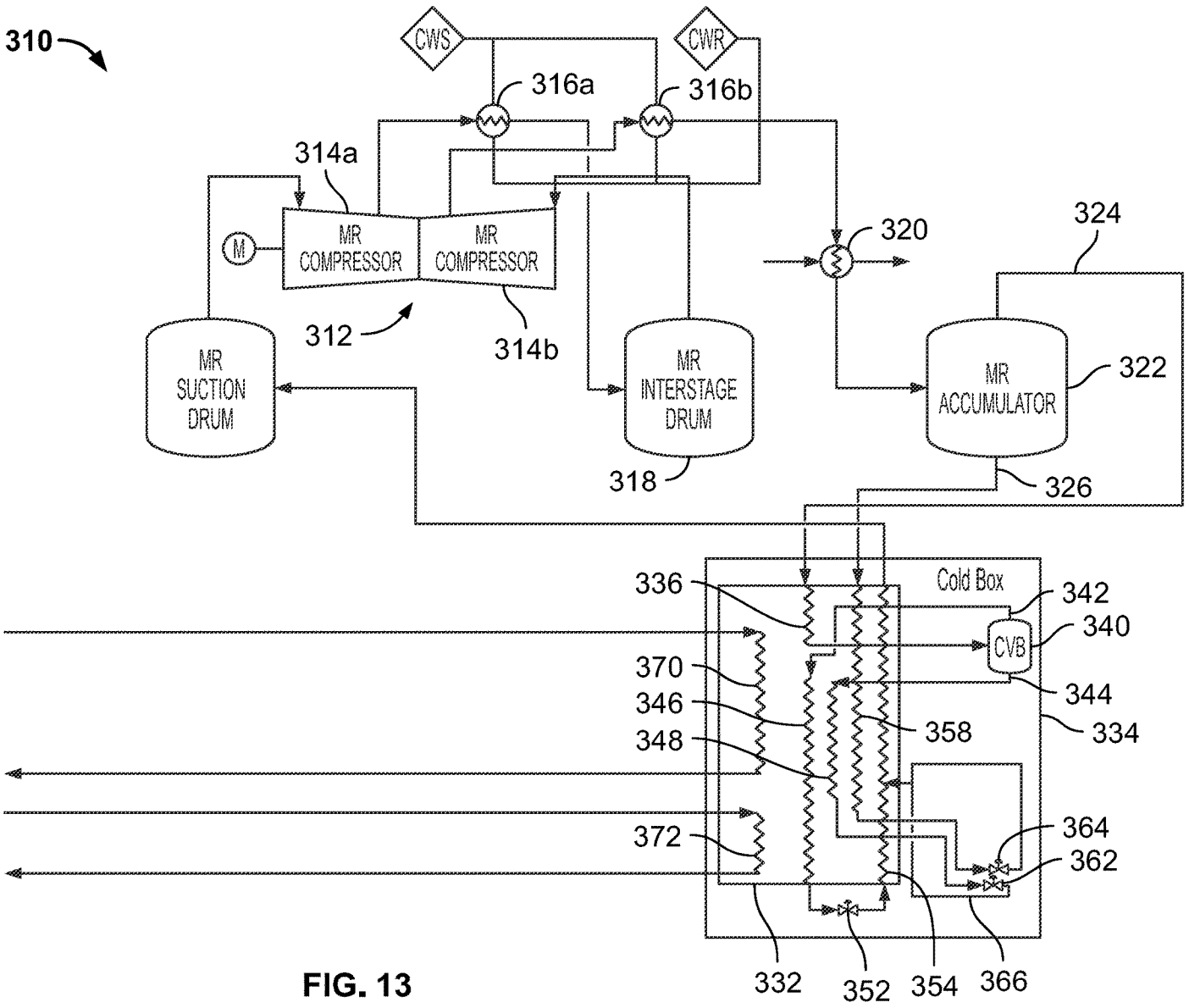
FIG. 13 is a process flow diagram and schematic illustrating an embodiment of a process and system of the invention for providing mixed refrigerant cooling for an acid gas distillation process.

The mixed refrigerant system of FIG. 13 utilizes a two-stage centrifugal compressor, indicated in general at 312, forming a first stage compressor 314*a* and a second stage compressor 314*b*. Alternatively, independent compressors may be used to provide the first and second compressor stages. The first stage discharge and the second stage discharge are cooled by a first stage aftercooler 316*a* and a second stage aftercooler 316*b*, respectively. As an example only, the aftercoolers 316*a* and 316*b* may use air or water cooling (ambient cooling). The discharge of the first stage compressor 314*a* is de-superheated via ambient cooling in the first stage aftercooler 316*a* and then sent to an interstage separation device, such as second stage suction drum 318. The second stage suction drum 318 removes any potential liquids, and the vapor is sent to the second stage compressor 314*b*. The discharge of the second stage compressor 314*b* is de-superheated and partially condensed via second stage aftercooler 316*b*. Optional additional condensing duty can be performed after ambient cooling using aftercooler 320 against process side cold loads.

With continued reference to FIG. 13, the partially condensed mixed refrigerant flow is sent to a high pressure accumulator 322. The vapor stream 324 and liquid stream 326 from the high pressure accumulator are separately fed to different passes in a heat exchanger 332. In a preferred embodiment, heat exchanger 332 is a brazed aluminum heat exchanger (BAHX) positioned within a cold box 334 for additional cooling. The high pressure accumulator vapor is partially condensed in a high pressure vapor passage 336 of the heat exchanger and sent to a cold vapor separator 340. The vapor stream 342 and liquid stream 344 from the cold vapor separator 340 are separately fed back to the heat exchanger for additional cooling in a cold separator vapor passage 346 and a cold separator liquid passage 348, respectively.

The cold vapor separator vapor stream 342 is condensed and subcooled in passage 346 and then is flashed across an expansion device 352, such as a Joules Thomson (T) valve. The resulting mixed phase refrigerant stream is directed to primary refrigeration passage 354.

The liquid stream 344 from the cold vapor separator is subcooled in the cold separator liquid cooling passage, while the liquid stream 326 from the high pressure accumulator 322 is subcooled in a high pressure liquid passage 358. The resulting subcooled streams can independently be flashed via expansion devices at 362 and 364 before combining into the middle temperature refrigerant stream 366, which is directed to the primary refrigeration passage 354.

The streams from passages 346, 348 and 358 exit the heat exchanger at appropriate locations based on the optimized amount of subcooling for each stream. The flashed mixed refrigerant streams are then fed back to the heat exchanger at the appropriate locations based on the stream temperatures. The flashing provides the temperature driving force/duty required for the acid gas distillation process cooling loads as well as the aforementioned cooling of fluid flowing in passages 346, 348 and 358.

The use of a BAHX/Cold Box system allows for multiple process side heating and cooling loads, and mixed refrigerant heating and cooling loads to be integrated into a single heat exchanger service. This helps to minimize the refrigeration load as multiple variables of the mixed refrigerant system (suction pressure, mixed refrigerant composition, subcooling temperatures, etc.) can be adjusted to provide cooling at the exact temperature ranges required. Additionally, the high surface area to volume ratio of BAHX allows for a low mean temperature differential and minimum internal temperature approaches resulting in lower refrigerant flow/duty requirements.

The net result is a compact refrigeration system, with a low refrigeration equipment count and equipment sizes relative to the process capacity. The number of exchanger services and expansion device locations, etc. of FIG. 13 can be adjusted to match the process requirements. While FIG. 13 shows two process side streams 370 and 372 for cooling process fluids for an acid gas distillation system, such as cooling feed fluid streams from the acid gas distillation system to generate reflux streams as the cooled feed fluid streams that are directed to the distillation columns of the Pellegrini '605 patent incorporated by reference above, the cold box can integrate significantly more process side streams if/when desirable. The system of FIG. 13 possesses the ability to integrate all of the acid gas distillation system and process cooling/heating loads with the mixed refrigerant in a heat exchanger (such as a BAHX) in order to improve the refrigeration efficiency, and reduce overall equipment count.

INCORPORATION BY REFERENCE

The contents of U.S. Pat. No. 10,345,039 to Gushanas et al., issued Jul. 9, 2019; U.S. Pat. No. 9,441,877 to Gushanas et al., issued Sep. 13, 2016; U.S. Pat. No. 6,333,445 to O'Brien, issued Dec. 25, 2001, and U.S. Pat. No. 9,945,605 to Pellegrini, issued Apr. 17, 2018, are hereby incorporated by reference.

While the preferred embodiments of the invention have been shown and described, it will be apparent to those skilled in the art that changes and modifications may be made therein without departing from the spirit of the invention, the scope of which is defined by the claims and elsewhere herein.

What is claimed is:

1. A system for cooling a feed fluid with a mixed refrigerant comprising:

a. a main heat exchanger including a warm end and a cold end with a feed fluid cooling passage extending therebetween, the feed fluid cooling passage being configured to receive a feed fluid at the warm end and to convey a cooled feed fluid out of the cold end, said main heat exchanger also including a high pressure vapor passage, a high pressure liquid passage, a cold separator vapor cooling passage, a cold separator liquid cooling passage and a primary refrigeration passage;

b. a mixed refrigerant compressor system including:

i) a compressor configured to receive a vapor phase or mixed phase refrigerant return stream from the primary refrigeration passage of the heat exchanger;

ii) an aftercooler configured to receive a compressed refrigerant stream from the compressor, said aftercooler having an aftercooler outlet; and iii) a high pressure separation device having an inlet in fluid communication with the aftercooler outlet and a high pressure liquid outlet and a high pressure vapor outlet;

c. said high pressure vapor passage of the heat exchanger configured to receive a high pressure vapor stream from the high pressure vapor outlet of the high pressure separation device and to cool the high pressure vapor stream to form a mixed phase stream;

d. a cold vapor separator configured to receive the mixed phase stream from the high pressure vapor passage of the heat exchanger, said cold vapor separator having a cold separator liquid outlet and a cold separator vapor outlet;

e. said cold separator vapor cooling passage of the heat exchanger configured to receive and condense a cold separator vapor stream from the vapor outlet of the cold vapor separator so that a condensed cold separator stream is formed;

f. a first expansion device configured to receive and expand the condensed cold separator stream from the cold separator vapor cooling passage of the heat exchanger so that a cold temperature refrigerant stream is formed;

g. said high pressure liquid passage of the heat exchanger having a first heat exchange passage length and configured to receive and subcool at least a portion of a mid-boiling refrigerant liquid stream from the high pressure liquid outlet of the high pressure separation device so that a subcooled mid-boiling refrigerant liquid stream is formed;

h. said cold separator liquid cooling passage of the heat exchanger having a second heat exchange passage length, wherein the first heat exchange passage is separate and distinct from the second heat exchange passage and the first heat exchange passage length is greater than the second heat exchange passage length, said cold separator liquid cooling passage configured to receive and subcool a cold separator liquid stream from the cold separator liquid outlet so that a subcooled cold separator liquid stream is formed;

i. a junction configured to combine the subcooled mid-boiling refrigerant liquid stream and the subcooled cold separator liquid stream while the subcooled mid-boiling refrigerant liquid stream is at, or colder via expansion than, the temperature of the subcooled mid-boiling refrigerant liquid stream in the subcooled state and the subcooled cold separator liquid stream is at, or colder via expansion than, the temperature of the subcooled cold separator liquid stream in the subcooled state so that a middle temperature refrigerant stream is formed; and j. said primary refrigeration passage of the heat exchanger configured to receive the cold temperature refrigerant stream from the first expansion device and the middle temperature stream from the junction and to thermally contact a feed fluid in the feed fluid cooling passage of the heat exchanger to form a cooled feed fluid in the feed fluid cooling passage and a vapor phase or mixed phase refrigerant return stream in the primary refrigeration passage.

2. The system of claim 1 wherein the junction includes a second expansion device configured to receive and expand the subcooled cold separator liquid stream from the cold separator liquid cooling passage of the heat exchanger and a third expansion device configured to receive and expand the subcooled mid-boiling refrigerant liquid stream from the high pressure liquid passage of the heat exchanger so that the subcooled cold separator liquid stream and the subcooled mid-boiling refrigerant liquid stream are combined while the subcooled cold separator liquid stream is colder via expansion than the temperature of the subcooled cold separator liquid stream in the subcooled state and the subcooled mid-boiling refrigerant liquid stream is colder via expansion than the temperature of the subcooled mid-boiling refrigerant liquid stream in the subcooled state.

3. The system of claim 2 further wherein the junction includes a junction accumulator separation device configured to receive and combine the expanded subcooled cold separator liquid stream and the expanded subcooled mid-boiling refrigerant liquid stream, said junction accumulator separation device having a vapor outlet and a fluid outlet in fluid communication with the primary refrigeration passage.

4. The system of claim 1 wherein the junction is configured to combine the subcooled cold separator liquid stream from the cold separator liquid cooling passage of the heat exchanger and the subcooled mid-boiling refrigerant liquid stream from the high pressure liquid passage of the heat exchanger so that a combined subcooled cold separator liquid and mid-boiling refrigerant liquid stream is formed and further comprising a fourth expansion device configured to receive and expand the combined subcooled cold separator liquid and mid-boiling refrigerant liquid stream so that the subcooled cold separator liquid stream and the subcooled mid-boiling refrigerant liquid stream are combined while the subcooled cold separator liquid stream is at the temperature of the subcooled cold separator liquid stream in the subcooled state and the subcooled mid-boiling refrigerant liquid stream is at the temperature of the subcooled mid-boiling refrigerant liquid stream in the subcooled state.

5. The system of claim 1 wherein the mixed refrigerant compression system further includes:

iv) an interstage separation device configured to receive cooled fluid from the aftercooler, said interstage separation device including a vapor outlet;

v) a second stage compressor configured to receive a vapor stream from the vapor outlet of the interstage separation device;

vi) a second stage aftercooler having an inlet configured to receive a compressed vapor stream from the second stage compressor and an outlet in fluid communication with the inlet of the high pressure accumulator.

6. The system of claim 5 wherein the interstage separation device includes a liquid outlet and the heat exchanger includes a pre-cool liquid passage and a pre-cool refrigeration passage, where the pre-cool liquid passage is configured to receive a high-boiling liquid stream from the liquid outlet of the interstage separation device and further comprising:

k. a pre-cool expansion device configured to received and flash a subcooled high-boiling liquid stream from the pre-cool liquid passage of the heat exchanger and direct a flashed fluid stream to the pre-cool refrigeration passage of the heat exchanger.

7. The system of claim 6 wherein the primary refrigeration passage includes the pre-cool refrigeration passage.

8. The system of claim 6 further comprising a splitting intersection and an interstage expansion device, said splitting intersection configured to receive the mid-boiling refrigerant liquid stream from the high pressure liquid outlet of the high pressure separation device and direct a first portion of the mid-boiling refrigerant liquid stream to the high pressure liquid passage of the heat exchanger and a second portion of the mid-boiling refrigerant liquid stream to the interstage expansion device so that an expanded cooled interstage fluid stream is formed and said interstage expansion device configured to direct the expanded cooled interstage fluid stream to the interstage separation device.

9. The system of claim 6 further comprising a return passage in fluid communication with an outlet of the primary refrigeration passage and an outlet of the pre-cool refrigeration passage, said return passage having an outlet in fluid communication with an inlet of the compressor of the mixed refrigerant compressor system.

10. The system of claim 6 further comprising a header outside of the heat exchanger in fluid communication with an outlet of the primary refrigeration passage and an outlet of the pre-cool refrigeration passage and having an outlet in fluid communication with an inlet of the compressor of the mixed refrigerant compressor system.

11. The system of claim 6 wherein the compressor and the second stage compressor include a two-stage compressor.

12. The system of claim 5 wherein the compressor and the second stage compressor include a two-stage compressor.

13. The system of claim 1 wherein the inlet of said high pressure separation device is configured to receive a stream comprising two or more C1-C5 hydrocarbons and optionally N2.

14. The system of claim 1 further comprising a suction separation device having an inlet in fluid communication with the primary refrigeration passage of the heat exchanger and an outlet in fluid communication with an inlet of the compressor of the mixed refrigerant compressor system.

15. The system of claim 1 wherein the heat exchanger includes a single heat exchanger, one or more heat exchangers arranged in parallel, or one or more heat exchangers arranged in series, or a combination thereof.

16. The system of claim 1 wherein the mixed refrigerant includes two or more of methane, ethane, ethylene, propane, propylene, butane, N-butane, isobutane, butylenes, N-pentane, isopentane, and a combination thereof.

17. The system of claim 1 further comprising one or more of an external treatment, pre-treatment, post-treatment or integrated treatment system, or a combination thereof, independently in fluid communication with the feed fluid cooling passage and configured to treat the feed fluid.

18. The system of claim 17 wherein at least one of the external treatment, pre-treatment and post-treatment systems is configured to perform at least one process selected from the group consisting of desulfurizing, dewatering, removing $CO_2$, removing one or more natural gas liquids (NGL), removing one or more freezing components, removing ethane, removing one or more olefins, removing one or more C6 hydrocarbons, removing one or more C6+ hydrocarbons and removing $N_2$ from the feed fluid.

19. The system of claim 1 wherein the heat exchanger is a plate-fin heat exchanger.

20. The system of claim 1 wherein the feed fluid is a fluid from an acid gas distillation system and the cooled feed fluid is a reflux fluid stream and the feed fluid cooling passage of the heat exchanger is configured to direct the reflux fluid stream to a distillation column of the acid gas distillation system.

* * * * *